United States Patent [19]

Ishikawa et al.

[11] Patent Number: 4,851,326

[45] Date of Patent: Jul. 25, 1989

[54] METHOD FOR PROCESSING SILVER HALIDE COLOR PHOTOGRAPHIC MATERIALS USING DEVELOPER SUBSTANTIALLY FREE OF BROMIDE AND BENZYL ALCOHOL

[75] Inventors: Takatoshi Ishikawa; Junya Nakajima, both of Kanagawa, Japan

[73] Assignee: Fuji Photo Film Co., Ltd., Kanagawa, Japan

[21] Appl. No.: 18,380

[22] Filed: Feb. 24, 1987

[30] Foreign Application Priority Data

Feb. 24, 1986 [JP] Japan ..... 61-39758
Jun. 3, 1986 [JP] Japan ..... 61-128740

[51] Int. Cl.[4] ..... G03C 7/30; G03C 5/24; G03C 7/32

[52] U.S. Cl. ..... 430/380; 430/372; 430/377; 430/461; 430/467; 430/478; 430/480; 430/507; 430/559

[58] Field of Search ..... 430/372, 377, 380, 464, 430/467, 478, 480, 567, 558

[56] References Cited

U.S. PATENT DOCUMENTS

| | | | |
|---|---|---|---|
| 3,996,054 | 12/1976 | Santenna et al. | 430/377 |
| 4,035,188 | 7/1977 | Yabata et al. | 430/467 |
| 4,299,914 | 11/1981 | Fujumastu et al. | 430/552 |
| 4,304,844 | 12/1981 | Fujumastu et al. | 430/552 |
| 4,443,536 | 4/1984 | Lestina | 430/552 |
| 4,524,132 | 6/1985 | Aoki et al. | 450/552 |
| 4,526,861 | 7/1985 | Ichijima et al. | 430/385 |
| 4,529,690 | 7/1985 | Ohbayashi et al. | 430/551 |
| 4,564,590 | 1/1986 | Sasaki et al. | 430/552 |
| 4,564,591 | 1/1986 | Tanaka et al. | 430/567 |
| 4,565,774 | 1/1986 | Kajiwara et al. | 430/382 |
| 4,565,777 | 1/1986 | Ogawa et al. | 430/552 |
| 4,590,153 | 5/1986 | Kawagishi et al. | 430/558 |
| 4,590,155 | 3/1986 | Klotzer | 430/567 |

FOREIGN PATENT DOCUMENTS

| | | |
|---|---|---|
| 211437 | 2/1987 | European Pat. Off. . |
| 19140 | 1/1935 | Japan . |
| 29461 | 8/1974 | Japan . |
| 52058 | 4/1980 | Japan . |
| 200037 | 12/1982 | Japan . |
| 31334 | 2/1983 | Japan . |
| 42045 | 3/1983 | Japan . |
| 50536 | 3/1983 | Japan . |
| 48755 | 3/1984 | Japan . |
| 174836 | 10/1984 | Japan . |
| 177553 | 10/1984 | Japan . |
| 177554 | 10/1984 | Japan . |
| 177555 | 10/1984 | Japan . |
| 177556 | 10/1984 | Japan . |
| 177557 | 10/1984 | Japan . |
| 178459 | 10/1984 | Japan . |
| 26338 | 2/1985 | Japan . |
| 26339 | 2/1985 | Japan . |
| 158444 | 8/1985 | Japan . |
| 158446 | 8/1985 | Japan . |
| 162256 | 8/1985 | Japan . |
| 172042 | 9/1985 | Japan . |
| 70552 | 4/1986 | Japan . |
| 330250 | 2/1987 | Japan . |

OTHER PUBLICATIONS

Research Disclosure, "Photographic Silver Halide Emulsions . . ." 12/1978, pp. 24.

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A silver halide color photographic material having at least one silver halide emulsion layer on a reflective support is, after having been imagewise exposed, subjected to color development with a color developer which does not substantially contain benzyl alcohol and which contains a bromide ion in an amount of $4\times10^{-3}$ mol/liter or less, for a period of time of 2 minutes or less, to obtain a color images with a high colored density. The silver halide color photographic material specifically has at least one silver chlorobromide emulsion layer which does not substantially contain silver iodide and which contains silver chloride in an amount of 50 mol % or more.

In the color images thus formed by the present process, the colored density is high and the fog is less.

23 Claims, No Drawings

METHOD FOR PROCESSING SILVER HALIDE COLOR PHOTOGRAPHIC MATERIALS USING DEVELOPER SUBSTANTIALLY FREE OF BROMIDE AND BENZYL ALCOHOL

FIELD OF THE INVENTION

The present invention relates to a process for processing silver halide color photographic materials, and more particularly, the invention relates to a processing process for color photographic materials including a very shortened color development time without using benzyl alcohol.

BACKGROUND OF THE INVENTION

Hitherto, various kinds of developing agent penetrants have been investigated for increasing the coloring property of color photographic light-sensitive materials and, in particular, a process of quickening color development by adding benzyl alcohol to a color developer has been widely used at present for the processing of color photographic materials because of accelerating a coloring effect, particularly color photographic papers.

However, in the case of using benzyl alcohol, diethylene glycol, triethylene glycol, alkanolamine, etc., must be used as the solvent thereof due to the low water solubility thereof. Since, however, the above-described compounds including benzyl alcohol have high BOD (biochemical oxygen demand) and COD (chemical oxygen demand) pollution loading values, it is preferred to avoid use of benzyl alcohol as much as possible.

Furthermore, even in the case of using the aforesaid solvent, it requires a long time to dissolve benzyl alcohol, and, hence, it is also better to avoid use of benzyl alcohol for the purpose of reducing the work load involved in preparing the solution of benzyl alcohol.

Also, when benzyl alcohol existing in a color developer is carried in a bleach bath or a blix (bleach-fix) bath which is a post-bath of the color developer, it causes the formation of the leuco dye of a cyan dye, which further causes the reduction of coloring density. Still further, when such benzyl alcohol exists in a bleaching solution or a blixing solution, it delays the washing out speed of developer components from color photographic materials, and, hence, it sometimes results in adverse influences on the stability or storability of color images of processed color photographic materials. Accordingly, it is also preferred to avoid use of benzyl alcohol for these reasons, also.

Color development is generally performed for about 3 to 4 minutes, but recently with the shortening of the time for delivering finished photographic products and the reduction of laboratory work, it has been desired to shorten the processing time for photographic materials.

On the other hand, when the development time for color photographic materials is shortened without using benzyl alcohol, which is a coloring accelerator, the coloring density is inevitably greatly reduced.

For solving the above-described problems, various color development accelerators have been described, for example, in U.S. Pat. Nos. 2,950,970, 2,515,147, 2,496,903, 2,304,925, 4,038,075, 4,119,462, British Pat. No. 1,455,413, Japanese patent application (OPI) Nos. 15831/78, 62450/80, 62451/80, 62452/80, 62453/80, 50536/83 and 162256/85 (the term "OPI" as used herein refers to a "published unexamined Japanese patent application"), Japanese patent publication Nos. 12422/76, 49728/80, etc. However, even by the use of these color development accelerators, a satisfactory coloring density has not yet been obtained.

Also, methods for incorporating color developing agents in color photographic materials are proposed as described, for example, in U.S. Pat. Nos. 3,719,492, 3,342,559, 3,342,597, Japanese patent application (OPI) Nos. 6235/81, 16133/81, 97531/82, 83565/82, etc., but these methods have disadvantages in that the color development is delayed and the formation of fog is increased, and, thus, are not proper methods.

Furthermore, a method of using a silver chloride emulsion as described, for example, in Japanese patent application (OPI) Nos. 95345/83, 232342/84, 19140/85, etc., may shorten the color development time but the formation of fog is likely to increase in the presence of benzyl alcohol.

Therefore, a method for forming of sufficient color images in a short period of time of 2 minutes or less, by using color developers which do not substantially contain benzyl alcohol, has not heretofore been found.

Bromide ion is generally used as a antifoggants in the color developers for silver halide color photographic materials, and the amount thereof to be added is from $5\times10^{-3}$ to $10\times10^{-3}$ mol/liter or so. In this connection, it is reasonable to assume that the reduction of the bromide ion concentration will result in the improvement of the color forming property of photographic materials. In the conventional color development method for processing color print papers in the presence of benzyl alcohol for 3 minutes or more, however, the reduction of the bromide ion concentration to that lower than the above-mentioned concentration causes a problem of an extreme increase of fog, and therefore, the reduction of the bromide ion concentration has been impossible in conventional methods up to the present.

For the reduction of the color development time, a method has been described using an emulsion which substantially comprises silver chloride, for example, in Japanese patent application (OPI) Nos. 19140/85, 37634/83, and 108533/83. However, when the color photographic materials with such emulsion are processed with color developers containing benzyl alcohol, the generation of fog is increased. For this, the use of the fog-prevention technique as described in Japanese patent application (OPI) Nos. 95345/83 and 232342/84 still is insufficient.

A method of quickening color development for 3 minutes for processing silver halide color photographic materials by the use of a color developer having a coupler that a specific group is introduced, and not containing a benzyl alcohol and a bromine ion is described in Japanese patent application (OPI) Nos. 174836/84 and 177553/84. However, it has been further desired to develop a new method for forming a color image with a sufficient color forming property of less fog, even in a short period of color development time of 2 minutes and 30 seconds or less.

SUMMARY OF THE INVENTION

Accordingly, the object of the present invention is to provide a method for processing silver halide color photographic materials by the use of a color developer which does not contain benzyl alcohol to form colored images with a sufficient color forming property of less fog, even in a short period of color development time of 2 minutes or less.

Another object of the present invention is to provide a method for processing silver halide color photographic materials by the color developer without any reversal process.

The object of the present invention can be achieved by a method for processing a silver halide color photographic material wherein a silver halide color photographic material having at least one silver halide emulsion layer on a reflective support is, after having been imagewise exposed, subjected to color development with a color developer which does not substantially contain benzyl alcohol and which contains bromide ion in an amount of $4\times10^{-3}$ mol/liter or less for a period of time of 2 minutes or less.

According to one preferred embodiment of the method of the invention, the silver halide color photographic material comprises at least one silver chlorobromide emulsion layer which does not substantially contain silver iodide and which contains silver chloride in an amount of more than 50 mol%.

According to another preferred embodiment of the method, the silver halide color photographic material contains a magenta coupler represented by formula (I)

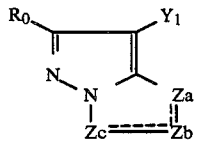

(I)

wherein $R_0$ represents a hydrogen atom or a substituent; $Y_1$ represents a group capable of being released by the coupling reaction with the oxidation product of an aromatic primary amine developing agent; Za, Zb, and Zc each represents a substituted or unsubstituted methine group, =N—, or —NH—; and at least one of said Za—Zb bond and said Zb—Zc bond is a double bond and the other is a single bond.

DETAILED DESCRIPTION OF THE INVENTION

In the present invention, the bromide ion concentration in the color developer is extremely reduced and the color forming property is improved, whcih has been, until now, impractical by any conventional processing method, as causing an extreme generation of fog in the colored images. Despite such circumstances, no fog occurred and the color forming property was extremely improved by the present invention, with the substantial elimination of benzyl alcohol from the color developer and the reduction of the color development time to 2 minutes or less, which was surprising and could not be expected at all from the prior art.

In addition, the generation of fog can be prevented and the color forming property can be improved further, by the use of a silver bromochloride emulsion having a silver chloride content of more than 50 mol%; and moreover, a far higher color forming property can be attained by the use of magenta coupler of formula (I).

The magenta couplers of formula (I) are further explained hereinafter.

In formula (I), $R_0$ represents a hydrogen atom or a substituent; $Y_1$ represents a hydrogen atom or a group capable of being released by a coupling reaction with the oxidation product of an aromatic primary amine developing agent; and Za, Zb, and Zc each represents a substituted or unsubstituted methine group, =N— or —NH—; one of the Za—Zb bond and the Zb—Zc bond being a double bond and the other being a single bond.

When the Zb—Zc bond is a carbon-carbon double bond, the double bond (Zb=Zc) may be a part of an aromatic ring. Also, the magenta coupler of formula (I) includes the case of forming a dimer or higher polymer at $R_0$ or $Y_1$. Furthermore, when Za, Zb, or Zc is a substituted methine, the compound of formula (II) includes the case of forming a dimer or higher polymer at the substituted methine.

A polymer as the compound represented by formula (I) means a compound having two or more moieties shown by formula (I) in 1 molecule and includes a bis compound and a polymeric coupler. The polymeric coupler may be a homopolymer composed of only of the monomer (preferably having a vinyl group, the monomer having a vinyl group is hereinafter referred to as a vinyl monomer) having the moiety shown by formula (I), or may be a copolymer composed of the abovedescribed monomer and a non-color-forming ethylenically unsaturated monomer which does not cause a coupling reaction with the oxidation product of an aromatic primary amine developing agent.

The magenta coupler represented by formula (I) is a nitrogen-containing 5-membered ring-condensed 5-membered ring type magenta coupler and the coloring mother nucleus thereof shows an aromaticity isoelectronic to naphthalene and has a chemical structures usually referred to as azapentalene.

Preferred examples of the magenta couplers represented by formula (I) include 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles represented by formulae (II), (III), (IV), (V), (VI), and (VII) shown below, respectively. In these couplers, the preferred couplers are those represented by formulae (IV), and (V), and the most preferred coupler is one represented by formula (V).

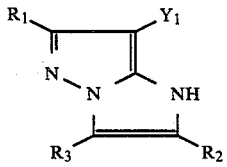

(II)

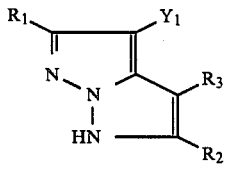

(III)

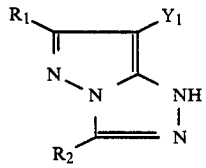

(IV)

-continued

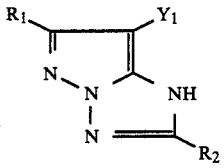

(V)

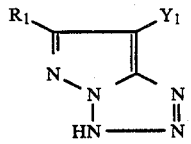

(VI)

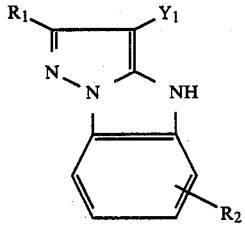

(VII)

In formulae (II) to (VII) described above, $R_1$, $R_2$ and $R_3$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group, and $Y_1$ represents a hydrogen atom, a halogen atom, a carboxyl group, or a coupling releasable group capable of being released upon coupling by being bonded with the carbon atom at the coupling position of the coupler through an oxygen atom, a nitrogen atom, or a sulfur atom.

The magenta couplers represented by formulae (II) to (VII) include the case that $R_1$, $R_2$, $R_3$ or $Y_1$ becomes a divalent group and each coupler forms a bis compound. Also, when a moiety represented by one of formulae (II) to (VII) exists in the vinyl monomer, $R_1$, $R_2$ or $R_3$ represents a simple bond or a connecting group and the moiety shown by formulae (II) to (VII) is bonded to a vinyl group through the bond or the connecting group.

In more detail, $R_1$, $R_2$ and $R_3$ each represents a hydrogen atom, a halogen atom (e.g., a chlorine atom, a bromine atom, etc.), an alkyl group (e.g., a methyl group, a propyl group, a t-butyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., dodecylsulfonyloxy group, etc.), an acylamino (e.g., an acetamido group, a benzamido group, a tetradecanamido group, an α-(2,4-di-t-amylphenoxy)butylamido group, a γ-(3-t-butyl-4-hydroxyphenoxy)butylamido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-t-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.) or an aryloxycarbonyl group (e.g., a phenyloxycarbonyl group, a 3-pentadecyloxycarbonyl group, etc.).

Also $Y_1$ in the above formulae represents a hydrogen atom, a halogen atom (e.g., a chlorine atom, a bromine atom, an iodine atom, etc.), a carboxyl group; a group bonded to the coupling position through an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxyl group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.); a group bonded to the coupling position through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-ethoxy-3-hydantoinyl group, a 2N-1,1-dioxo-3(2H)-oxo-1,2-benzisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.); or a group bonded to the coupling position through a sulfur atom (e.g., a phenylthio group, a 2-carboxyphenylthio group, a 2-methoxy-5-tert-octylphenylthio group, 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

When $R_1$, $R_2$, $R_3$ or $Y_1$ in one of formulae (II) to (VII) described above becomes a divalent group and the magenta coupler represented by formula (I) forms a bis-compound, the divalent group is explained below in more detail. That is, the divalent group includes a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

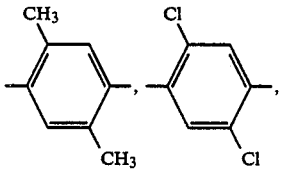

etc.), an $—NHCO—R_4—$ group (wherein $R_4$ represents a substituted or unsubstituted alkylene or a substituted or unsubstituted phenylene group), or a —CONH— group.

The connecting group shown by $R_1$, $R_2$ or $R_3$ when the moiety shown by one of formulae (II) to (VII) exists in a vinyl monomer as described above includes a group formed by combining the groups selected from substituted or unsubstituted alkylene group, e.g., a methylene group, an ethylene group, a 1,10-decylene group, $—CH_2CH_2—O—CH_2CH_2—$, etc.), substituted or unsubstituted phenylene group (e.g., a 1,4-phenylene group, a 1,3-phenylene group,

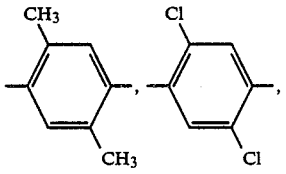

etc.), —NHCO—, —CONH—, —O—, —OCO—, and aralkylene group (e.g.,

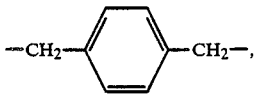

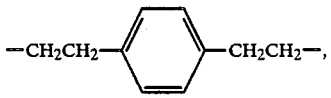

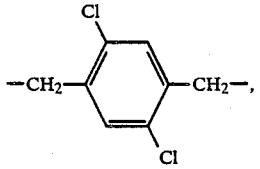

etc.)

In addition, the vinyl group in the vinyl monomer may further have other substituents in addition to the coupler moiety represented by formulae (II) to (VII). Examples of the preferred substituents are a hydrogen atom, a chlorine atom, and a lower alkyl group having from 1 to 4 carbon atoms.

As the non-coloring ethylenically unsaturated monomer without coupling with the oxidation product of an aromatic primary amine developing agent, which forms the copolymer together with the vinyl monomer having the moiety represented by one of formulae (II) to (VII), there are acrylic acid, α-chloroacrylic acid, α-aracrylic acid (e.g., methacrylic acid, etc.), the esters or amides induced from the aforesaid acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), methylenedibisacrylamide, vinyl esters (e.g., vinyl acetate, vinyl propionate, vinyl laurate, etc.), acrylonitrile, methacrylonitrile, aromatic vinyl compound (e.g., styrene and the derivatives thereof, vinyltoluene, divinylbenzene, vinylacetophenone, sulfostyrene, etc.), itaconic acid, citraconic acid, crotonic acid, vinylidene chloride, vinyl alkyl ethers (e.g., vinyl ethyl ether, etc.), maleic acid, maleic anhydride, a maleic acid ester, N-vinyl-2-pyrrolidone, N-vinylpyridine, 2-vinylpyridine, 4-vinylpyridine, etc.

The copolymer may have two or more of the non-coloring ethylenically unsaturated monomers.

In the mentioned formulae (IV) and (V), at least one of $R_1$ and $R_2$ is preferably a branched substituted or unsubstituted alkyl group, that is, an alkyl group or a substituted alkyl group which is connected to a pyrazoloazole skeleton through a secondary or tertiary carbon atom, wherein a secondary carbon atom means a carbon atom to which only one hydrogen atom is directly connected, and a tertiary carbon atom means a carbon atom to which no hydrogen atom but preferably an alkyl group or a substituted alkyl group is directly connected. The examples of the substituted alkyl group are a sulfonamidoalkyl group, a sulfonamidoarylalkyl group, a sulfonylalkyl group and the like.

As a magenta coupler of formula (I), it is also preferred to use couplers represented by formula (VIII) or (IX):

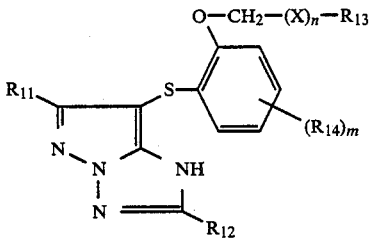

(VIII)

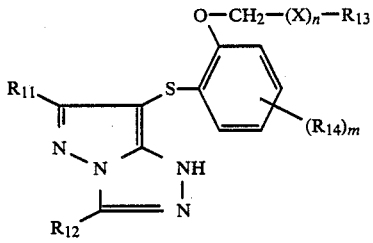

(IX)

wherein $R_{11}$ and $R_{12}$ each represents a substituent as defined by $R_1$ and $R_2$, at least one of said $R_{11}$ and $R_{12}$ representing a group bonding to the pyrazoloazole nucleus by a nitrogen atom, oxygen atom, or sulfur atom thereof as exemplified before; X represents $-CH_2-O-$, $-CH_2O-CH_2CH_2O-$, $-CH_2SO_2-$, $-CH_2CH_2CH_2SO_2NH-$, $-CH_2CH_2CH_2SO_2NHCH_2CH_2O-$, $-CH_2CH_2CONH-$, $-CH_2-COO-$, $-CH_2CONH-$, $-CH_2CH_2CH_2CONH-$, $-CH_2CH_2SO_2-$, $-CH_2CH_2SO_2NH-$, $-CH_2CH_2NHSO_2-$, $-CH_2NHSO_2-$, $-CH_2NHCO-$,

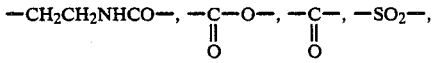

-continued

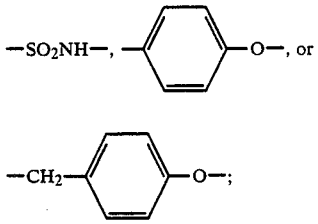

$R_{13}$ represents an alkyl group or an aryl group; $R_{14}$ represents a halogen atom, an alkoxy group, an alkyl group, an aryl group, a hydroxyl group, an amino group, an N-alkylamino group, an N,N-dialkylamino group, an N-anilino group, an acylamino group, a ureido group, an alkoxycarbonylamino group, an imido group, a sulfonamido group, a sulfamoylamino group, an alkoxycarbonyl group, a carbamoyl group, an acyl group, a cyano group, or an alkylthio group; n represents 0 or 1; m represents 0 or an integer of 1 to 4; and when m is 2 or more, said $R_{14}$ groups may be the same or different. As specific examples of the alkyl group, the aryl group, etc. represented by $R_{13}$ or $R_{14}$, those of the alkyl group, the aryl group, etc. as enumerated for formula (I) described above can be exemplified.

In the preferred compounds represented by formula (VIII), $R_{11}$ is an alkoxy group, a ureido group, or an aryloxy group, and $R_{12}$ is an alkyl group.

Also, in the preferred compounds represented by formula (IX), $R_{11}$ is an alkyl group or an alkoxy group, and $R_{12}$ is an alkylthio group.

Examples and synthesis examples of the couplers represented by formulae (II) to (VII) described above are described, e.g., in the literature noted below.

Compounds of formula (II) are described in Japanese patent application (OPI) No. 162548/84, compounds of formula (III) are described in Japanese patent application (OPI) No. 43659/85, compounds of formula (IV) are described in Japanese patent publication No. 27411/72, compounds of formula (V) are described in Japanese patent application (OPI) Nos. 171956/84 and 172982/85, compounds of formula (VI) are described in Japanese patent application (OPI) No. 33552/85 and compounds of formula (VII) are described in U.S. Pat. No. 3,061,432.

Also, the high coloring ballast groups described in Japanese patent application (OPI) Nos. 42045/83, 214854/84, 177553/84, 177554/84 and 177557/84 can be applied to the compounds of formulae (II) to (VII) described above.

Specific examples of the pyrazoloazole series couplers of formula (I) described above are illustrated below, but the compounds for use in this invention are not limited thereby.

(M-1)

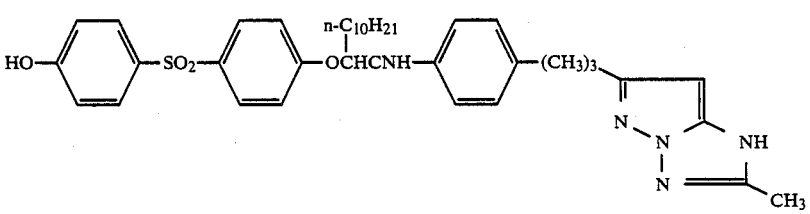

-continued
(M-2)
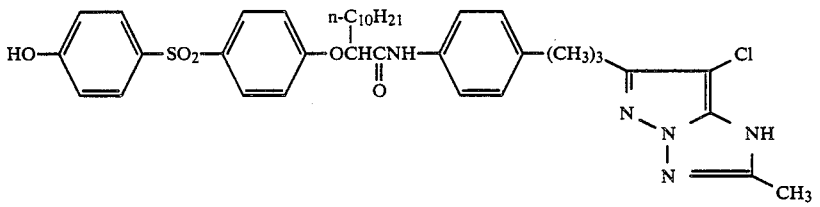
(M-3)
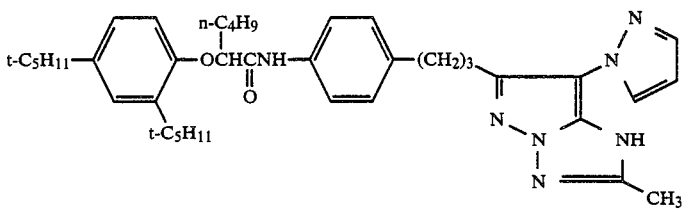
(M-4)
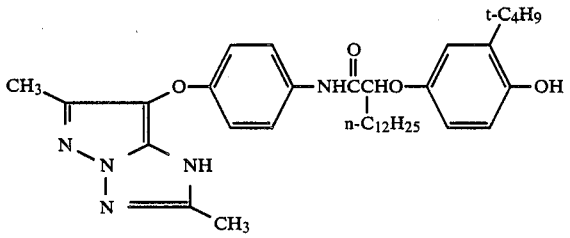
(M-5)
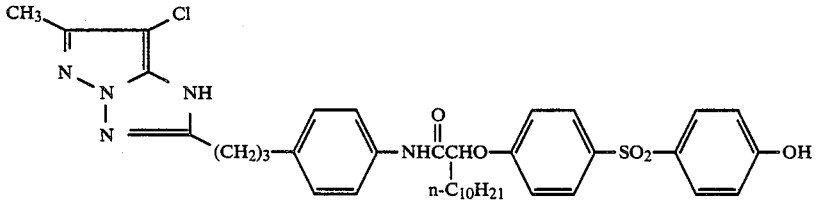
(M-6)
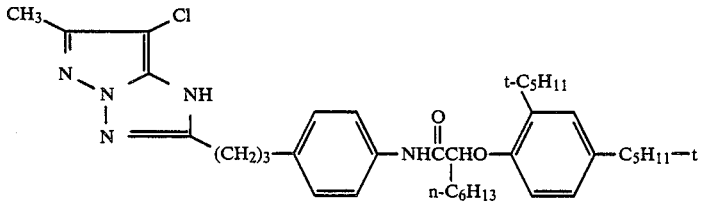
(M-7)
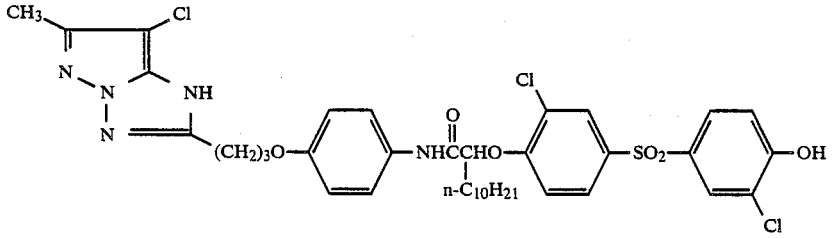
(M-8)
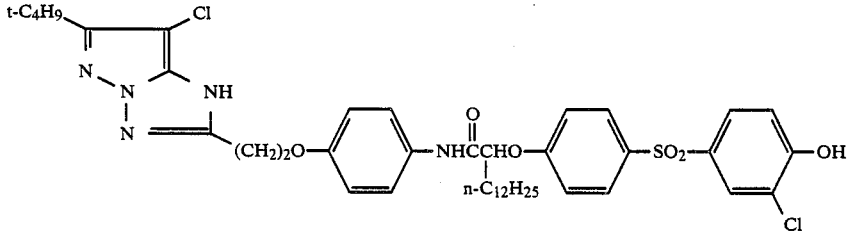

-continued
(M-9)
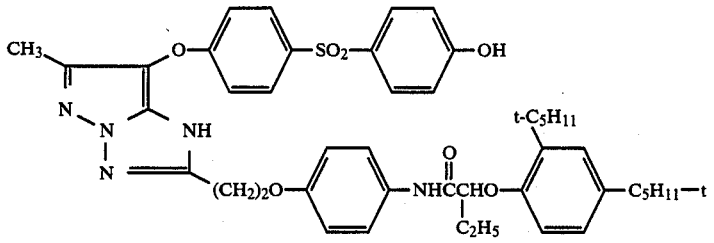
(M-10)
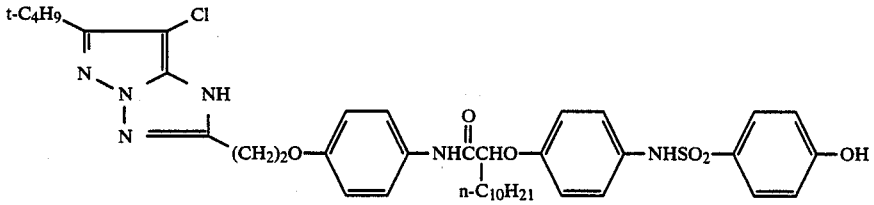
(M-11)
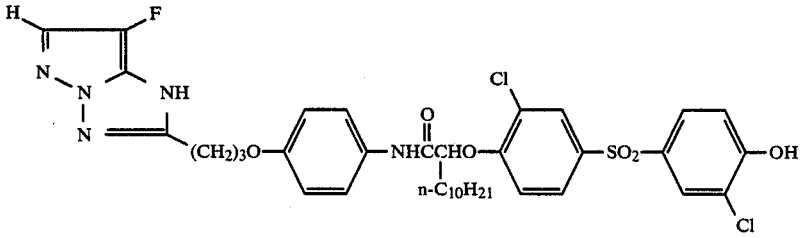
(M-12)
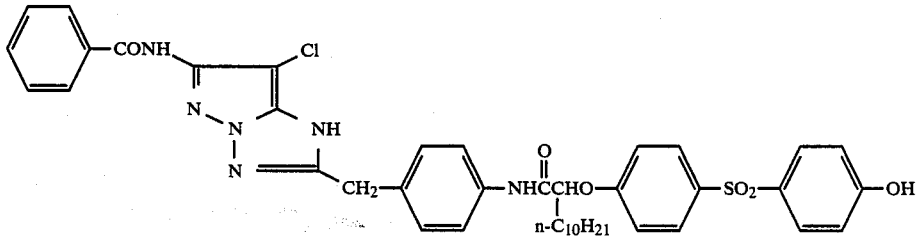
(M-13)
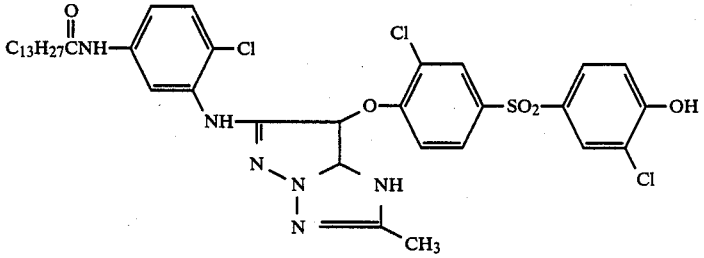
(M-14)
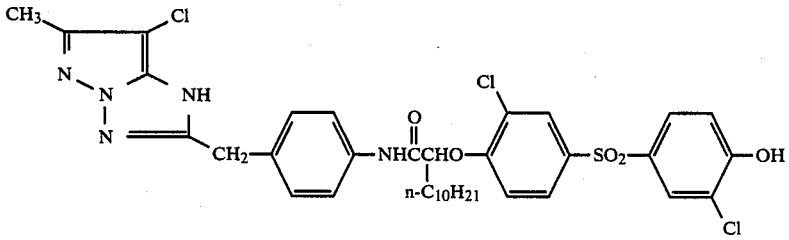

-continued
(M-15)
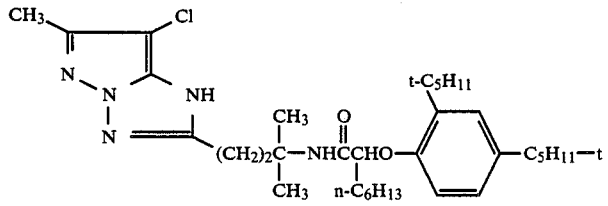
(M-16)
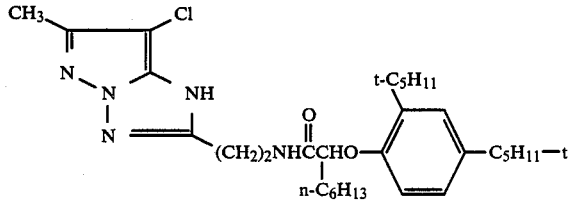
(M-17)
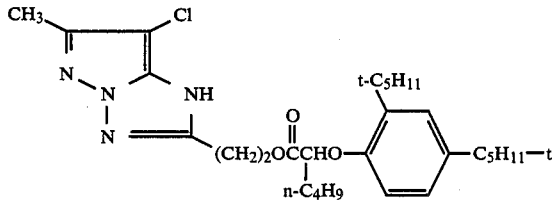
(M-18)
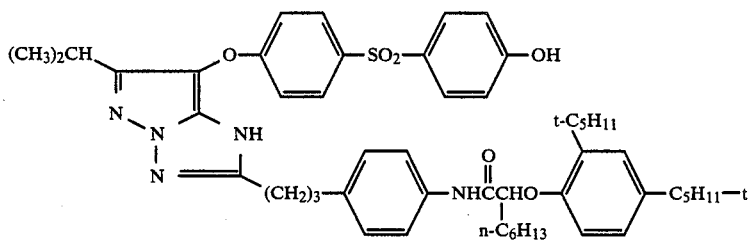
(M-19)
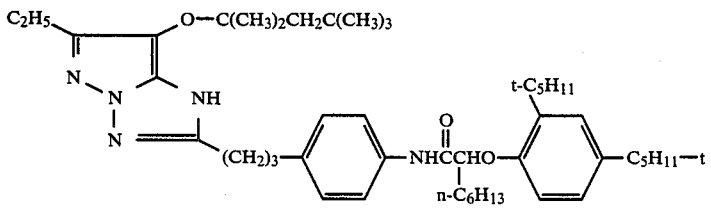
(M-20)
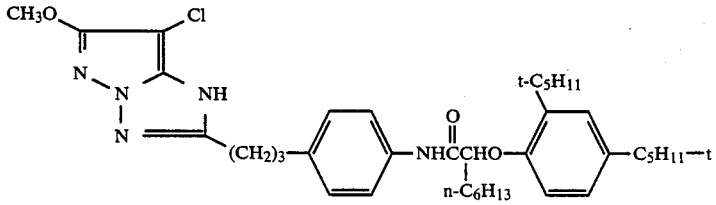
(M-21)
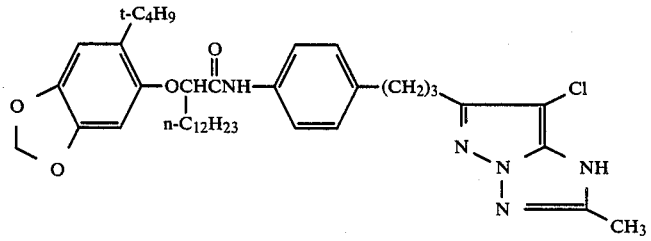

-continued
(M-22)
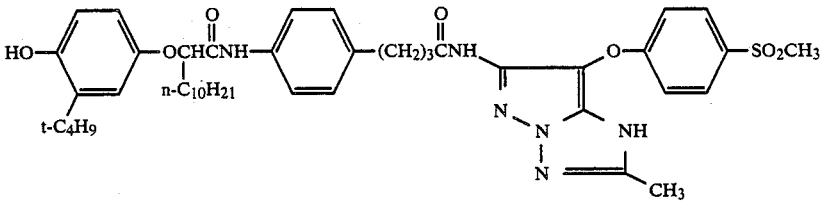
(M-23)
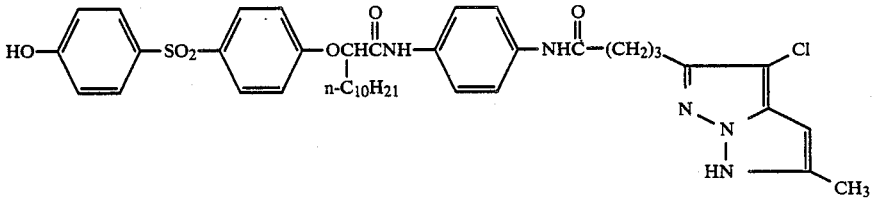
(M-24)
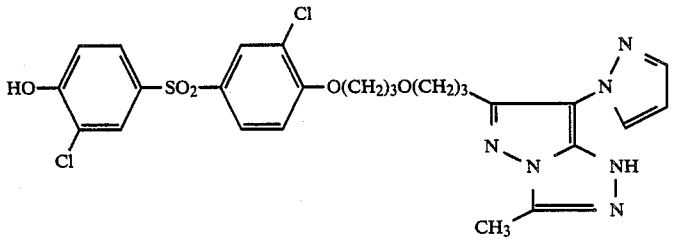
(M-25)
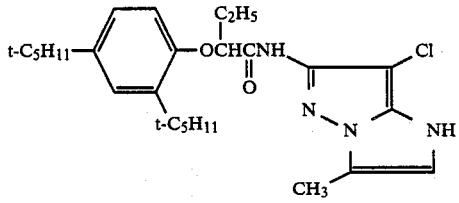
(M-26)
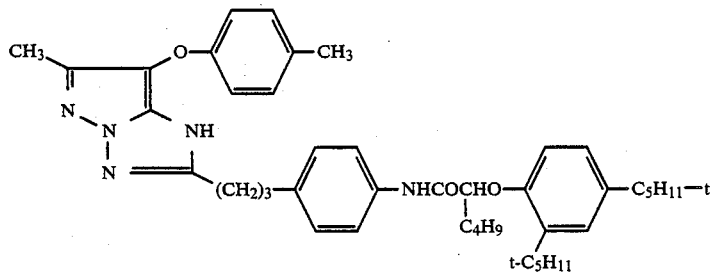
(M-27)
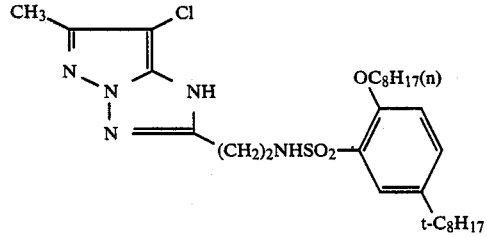
(M-28)
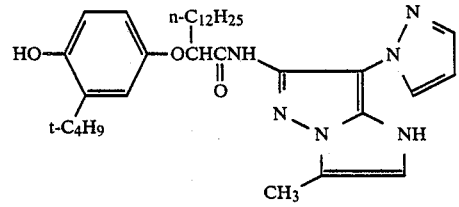

-continued
(M-29)
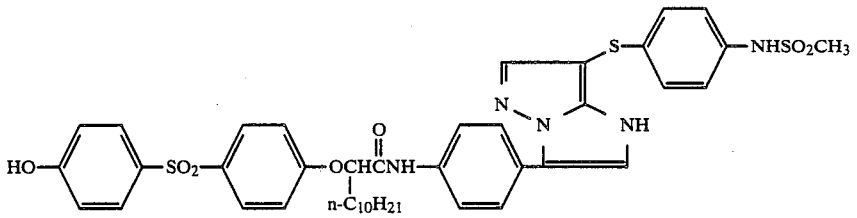
(M-30)
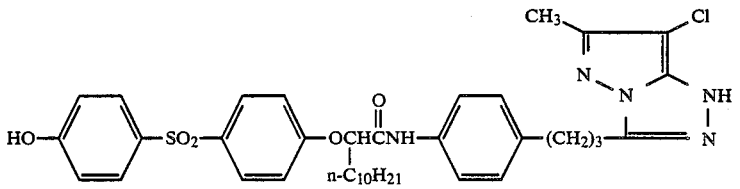
(M-31)
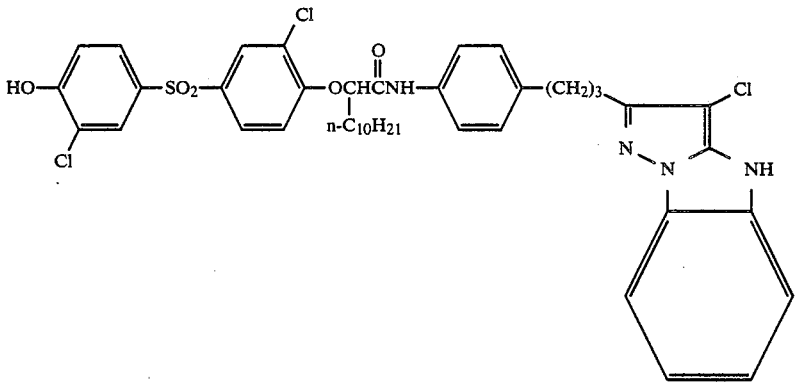
(M-32)
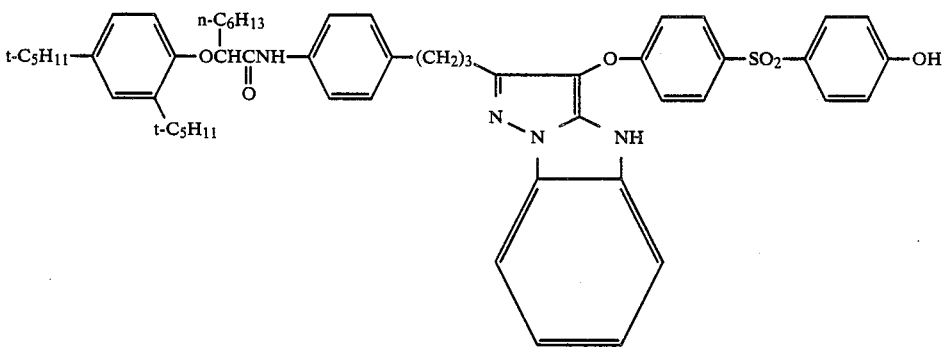
(M-33)
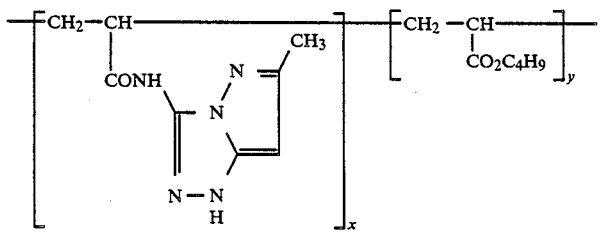
x/y = 50/50 (weight ratio)

-continued
(M-34)
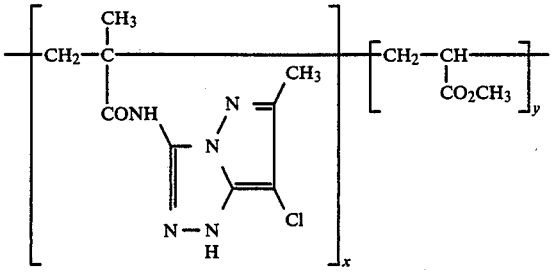
x/y = 40/60
(M-35)
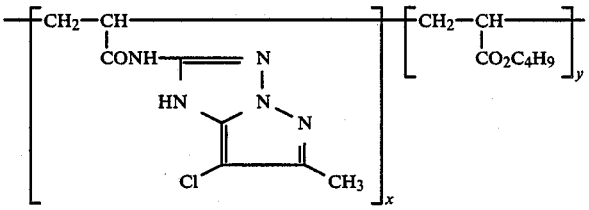
x/y = 50/50
(M-36)
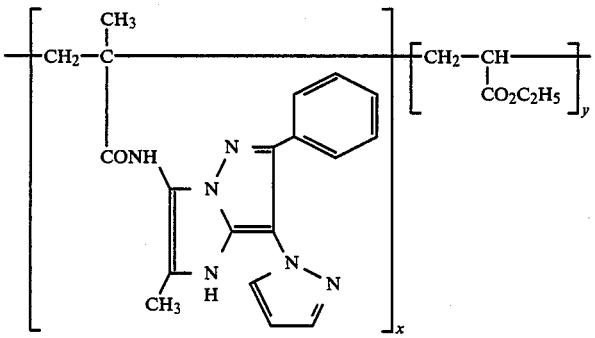
x/y = 55/45
(M-37)
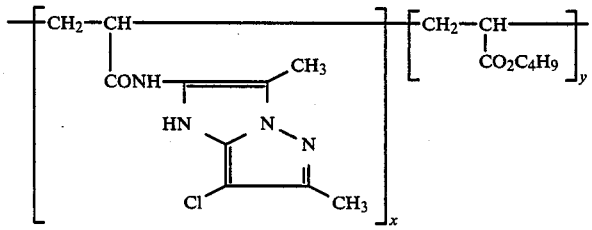
x/y = 50/50
(M-38)
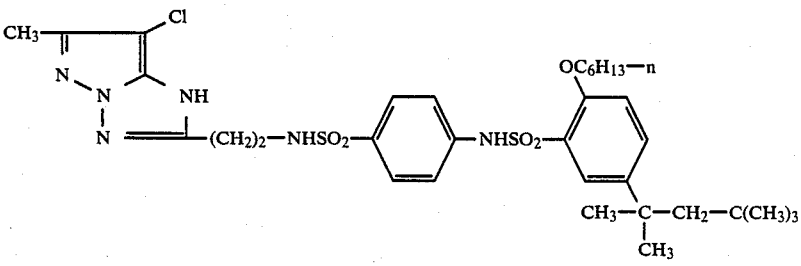

-continued
(M-39)
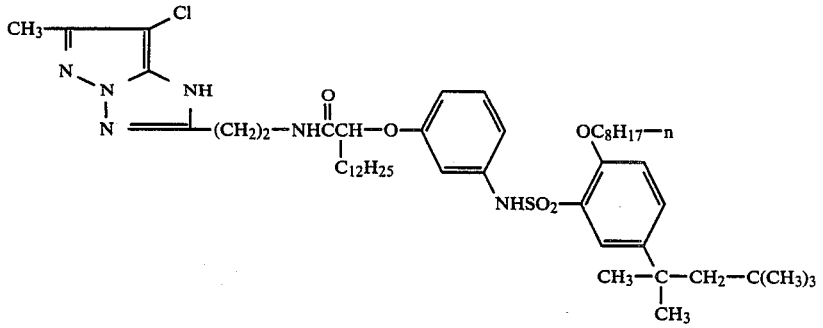
(M-40)
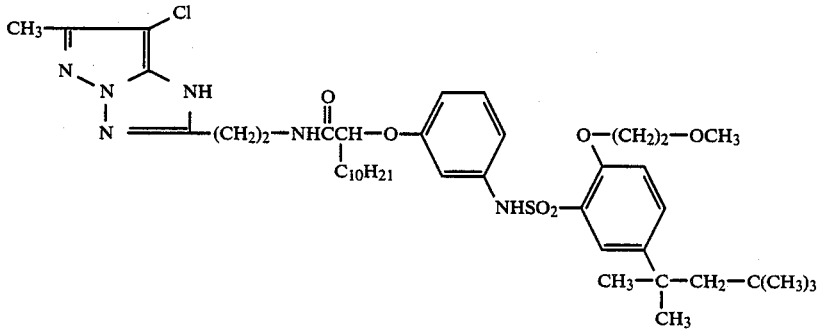
(M-41)
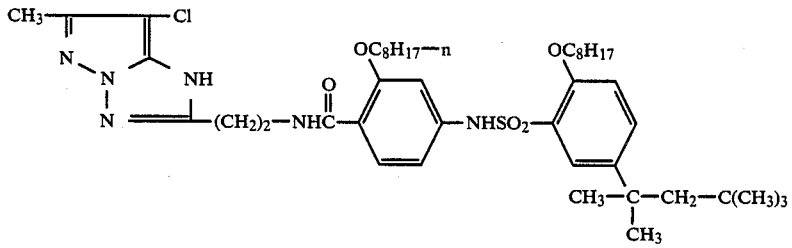
(M-42)
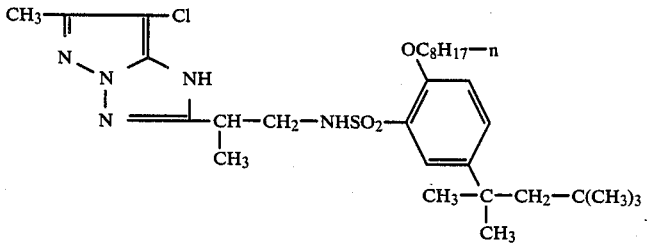
(M-43)
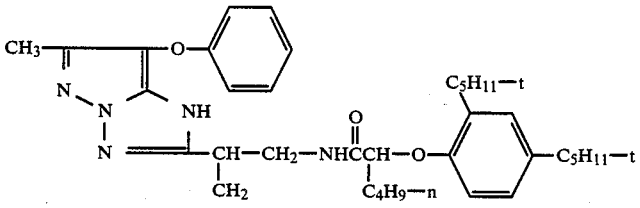

-continued
(M-44)
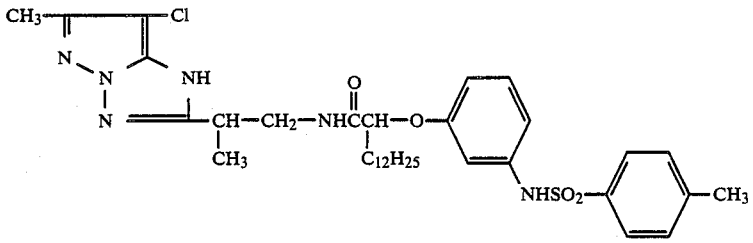
(M-45)
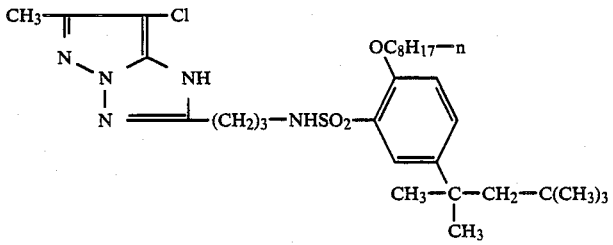
(M-46)
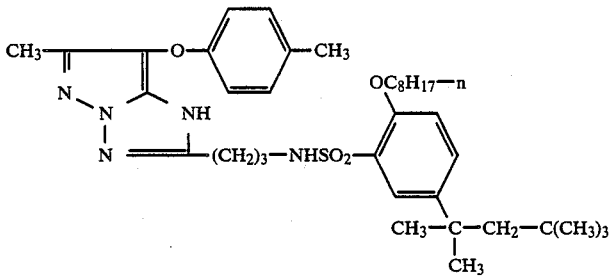
(M-47)
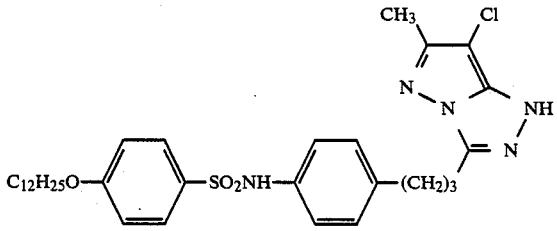
(M-48)
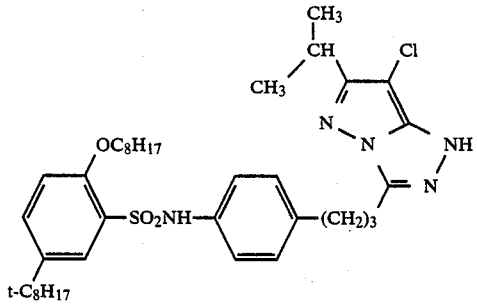
(M-49)
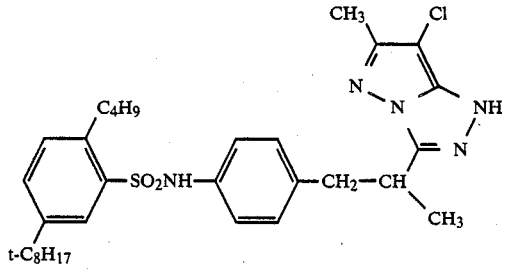

-continued
(M-50)
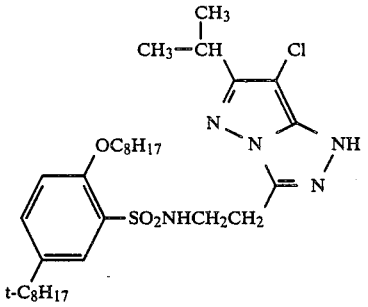
(M-51)
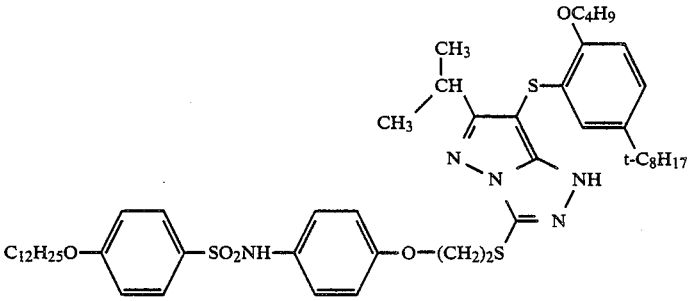
(M-52)
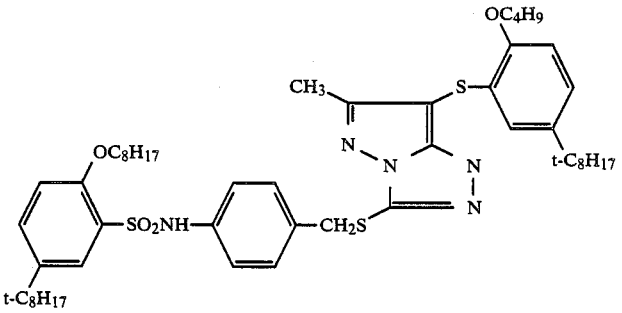
(M-53)
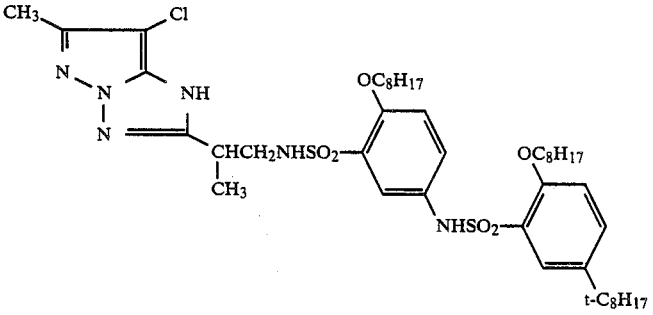
(M-54)
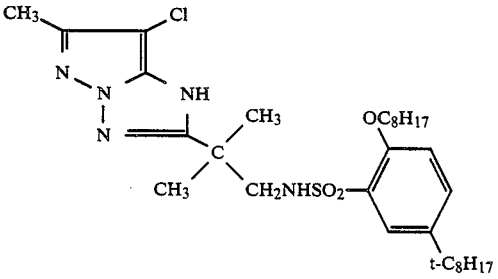

-continued
(M-55)
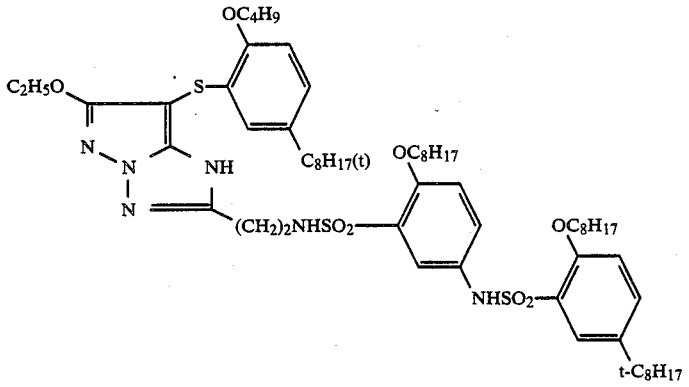
(M-56)
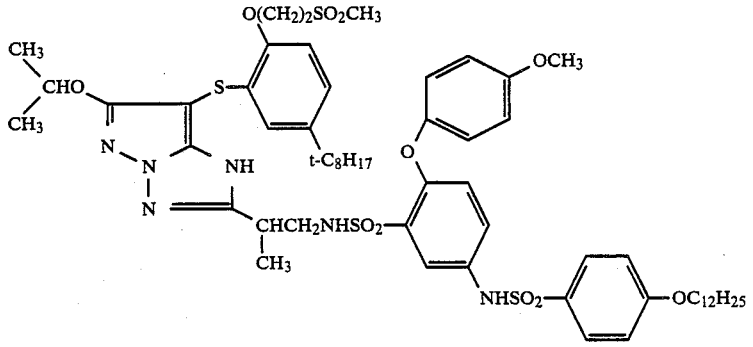
(M-57)
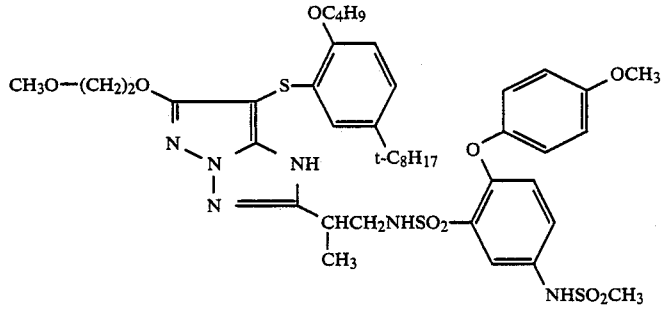
(M-58)
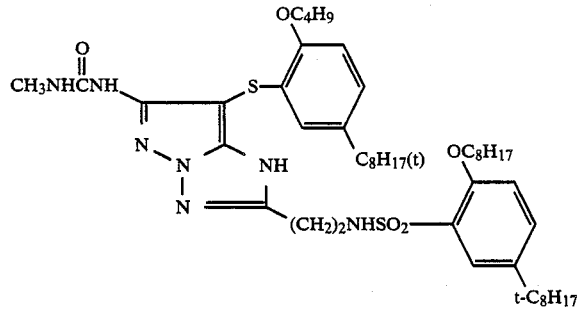
(M-59)
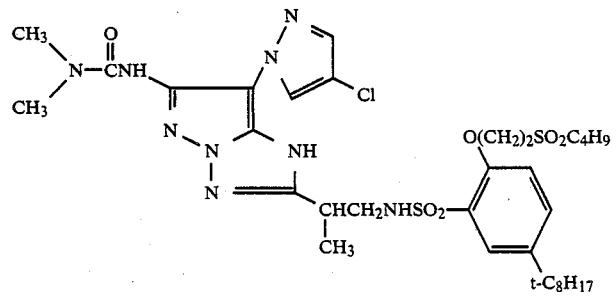

-continued (M-60)

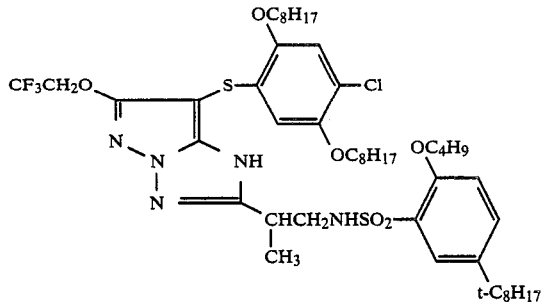

The magenta coupler described above is incorporated in a silver halide emulsion in an amount of from $2\times10^{-3}$ mol to $5\times10^{-1}$ mol, preferably from $1\times10^{-2}$ mol to $5\times10^{-1}$ mol, per mol of silver in the emulsion layer.

The above-described couplers may be used as combinations of two or more kinds of the couplers for the same photographic layer in order to meet the characteristics required for a color photographic light-sensitive material or the same kind of the coupler may be incorporated in two or more photographic layers.

For introducing the coupler(s) into a silver halide emulsion layer, known methods as described, for example, in U.S. Pat. No. 2,322,027, etc., can be used. For example, the coupler is dissolved in a high boiling point organic solvent such as phthalic acid alkyl esters (dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamide (e.g., diethyllaurylamide, etc.), fatty acid esters (e.g., dibutoxyethyl succinate, diethyl azelate, etc.), trimesic acid esters (e.g., tributyl trimesate, etc.), etc., or a low boiling point organic solvent having boiling point of from about 30° C. to 150° C. such as low alkyl acetates (e.g., ethyl acetate, butyl acetate, etc.), ethyl propionate, sec-butyl alcohol, methyl isobutyl ketone, β-ethoxyethyl acetate, methyl cellosolve acetate, etc., and then dispersed in an aqueous hydrophilic colloid solution as the organic solvent solution. A mixture of the aforesaid high boiling point organic solvent and low boiling point organic solvent may be used for the above-described purpose.

Then, the color developer for use in the present invention is described in detail.

The color developer for use in the present invention does not substantially contain benzyl alcohol. The term "does not substantially contain benzyl alcohol" means that the developer contains preferably no greater than about 2.0 ml/l (liter) of benzyl alcohol, more preferably no greater than 0.5 m/l of benzyl alcohol, and most preferably contains no benzyl alcohol.

The color developer for use in the present invention contains an aromatic primary amine color developing agent. Preferred examples of the color developing agent are p-phenylenediamine derivatives. Specific examples thereof are illustrated below but the developing agents for use in the present invention are not limited by these compounds.

D-1: N,N-Diethyl-p-phenylenediamine

D-2: 2-Amino-5-diethylaminotoluene

D-3: 2-Amino-5-(N-ethyl-N-laurylamino)toluene

D-4: 4-[N-Ethyl-N-(β-hydroxyethyl)amino]aniline

D-5: 2-Methyl-4-[N-ethyl-N-(β-hydroxyethyl-)amino]aniline

D-6: N-Ethyl-N-(β-methanesulfonamidoethyl)-3-methyl-4-aminoaniline

D-7: N-(2-Amino-5-diethylaminophenylethyl)methanesulfonamide

D-8: N,N-Dimethyl-p-phenylenediamine

D-9: 4-amino-3-methyl-N-ethyl-N-methoxyethylaniline

D-10: 4-Amino-3-methyl-N-ethyl-N-β-ethoxyethylaniline

D-11: 4-Amino-3-methyl-N-ethyl-N-β-butoxyethylaniline

Also, the p-phenylenediamine derivative may be used as a form of the salt thereof, such as the sulfate, hydrochloride, sulfite, p-toluenesulfonate, etc.

The amount of the aromatic primary amine developing agent is from about 0.1 g to about 20 g, and preferably from about 0.5 g to about 10 g, per liter of a developer solution.

The color developer for use in the present invention may further contain a hydroxylamine as well known. The hydroxylamine may be used as the form of a free amine in the color developer, but it generally used as the form of a water-soluble acid salt thereof. Examples of such a salt of hydroxylamine include sulfides, oxalates, hydrochlorides, phosphates, carbonates, acetates, etc. The hydroxylamine may be substituted or unsubstituted. For example, the nitrogen atom of the hydroxylamine may be substituted by an alkyl group. In particular, the use of substituted hydroxylamines is preferred in view of the improvement of the color forming property.

The amount of the hydroxylamines to be added is preferably up to 10 g, more preferably up to 5 g, per liter of the color developer. The amount thereof is preferably as small as possible provided that the stability of the color developer can be kept surely, in view of the generation of fog.

The color developers of the present invention preferably contain, as a preservative, a sulfite such as sodium sulfite, potassium sulfite, sodium bisulfite, potassium bisulfite, sodium meta-sulfite or potassium meta-sulfite, or a carbonyl-sulfite adduct. The amount of the said additive to be incorporated is preferably up to 20 g/liter, and more preferably up to 5 g/liter; and the amount is preferably as small as possible provided that the stability of the color developers can be maintained.

Other preservatives which can be used in the present invention are aromatic polyhydroxy compounds as described in Japanese patent application (OPI) Nos. 49828/77, 47038/81, 32140/81 and 160142/84, and U.S. Pat. No. 3,746,544; hydroxyacetones as described in U.S. Pat. No. 3,615,503 and British Pat. No. 1,306,176; α-aminocarbonyl compounds as described in Japanese patent application (OPI) Nos. 143020/77 and 89425/78; various kinds of metals as described in Japanese patent application (OPI) Nos. 44148/82 and 53749/82; various kinds of saccharides as described in Japanese patent application (OPI) No. 102727/77; hydroxamic acids as described in Japanese patent application (OPI) No. 27638/77; αα'-dicarbonyl compounds as described in Japanese patent application (OPI) No. 160141/84; salicylic acids as described in Japanese patent application (OPI) No. 180588/84; alkanolamines as described in Japanese patent application (OPI) No. 3532/79; poly(alkylenimines) as described in Japanese patent application (OPI) NO. 94349/81; gluconic acid derivatives as described in Japanese patent application (OPI) No. 75647/81, etc. Two or more kinds of preservatives can be used together if desired. In particular, the addition of aromatic polyhydroxy compounds or alkanolamines is preferred.

The color developers to be used in the present invention preferably have a pH of from 9 to 12, and more preferably a pH of from 9 to 11.0; and the color developers may further contain compounds of other known developer components.

In order to maintain the pH of the developers as mentioned above, the use of various kinds of buffers is preferred. Buffers which can be used therefor include, for example, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. In particular, carbonates, phosphates, tetraborates and hydroxybenzoates have high dissolubility and high buffer capacity in a high pH range of pH 9.0 or more, and the use of these buffers are especially preferred, since these buffers have various merits in that the addition thereof to color developers does not cause any adverse influence (such as fog) on the photographic characteristics of the developers, and they are inexpensive.

Specific examples of these buffers are sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate, (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, these compounds are not whatsoever limitative in the practice of the present invention.

The concentration of the buffer in the color developer is preferably 0.1 mol/liter or more, and particularly preferably from 0.1 mol/liter to 0.4 mol/liter.

Furthermore, the color developer may contain a chelating agent for preventing the precipitation of calcium, magnesium, etc., such as polyphosphates, aminopolycarboxylic acids, phosphonocarboxylic acids, aminopolyphosphonic acids, 1-hydroxyalkylidene-1,1-diphosphonic acids, etc.

Preferred chelating agents are organic acid compounds, for example, including amino-polycarboxylic acids as described in Japanese patent publication Nos. 30496/73 and 30232/69; organic phosphonic acids as described in Japanese patent application (OPI) No. 97347/81, Japanese patent publication No. 39359/81 and German Pat. No. 2,227,639; phosphonocarboxylic acids as described in Japanese patent application (OPI) Nos. 102726/77, 42730/78, 121127/79, 126241/80, and 65956/80; and compounds as described in Japanese patent application (OPI) Nos. 195845/83 and 203440/83 and Japanese patent publication No. 40900/78. Specific examples of such chelating agents are set forth below, which, however, are not whatsoever limitative.

Nitrilo-triacetic acid,
Diethylenetriamine-pentaacetic acid,
Triethylenetetramine-hexaacetic acid,
Ethylenediamine-tetraacetic acid,
N,N,N-trimethylene-phosphonic acid,
Ethylenediamine-N,N,N',N'-tetramethylene-phosphonic acid,
1,3-diamino-2-propanol-tetraacetic acid,
Trans-cyclohexanediamine-tetraacetic acid,
Nitrilo-tripropionic acid,
1,2-diaminopropane-tetraacetic acid,
Hydroxyethylimino-diacetic acid,
Glycoletherdiamine-tetraacetic acid,
Hydroxyethylenediamine-triacetic acid,
Ethylenediamine-orthohydroxyphenyl-acetic acid,
2-phosphonobutane-1,2,4-tricarboxylic acid,
1-hydroxyethane-1,1-diphosphonic acid,
N,N'-bis(2-hydroxybenzyl)ethylenediamine-N,N'-diacetic acid.

These chelating agents can be used in the form of a combination of two or more thereof, if desired.

The amount of the said chelating agent to be added to the color developer may be such that is sufficient for blockading the metal ions in the color developer. For instance, the amount is from about 0.1 to 10 g per liter of the developer.

The color developers of the present invention may contain various kinds of development accelerators. The development accelerators include, for example, thioether-type compounds as described in Japanese patent publication Nos. 16088/62, 5987/62, 7826/63, 12380/69, and 9019/70 and U.S. Pat. No. 3,813,247; p-phenylenediamine-type compounds as described in Japanese patent application (OPI) Nos. 49829/77 and 15554/75; quaternary ammonium salts as described in Japanese patent application (OPI) Nos. 137726/75, Japanese patent publication No. 30074/69, Japanese patent application (OPI) Nos. 156826/81 and 43429/77; p-aminophenols as described in U.S. Pat. Nos. 2,610,122 and 4,119,462; amine-type compounds as described in U.S. Pat. Nos. 2,494,903, 3,128,182, 4,230,796, and 3,253,919, Japanese patent publication No. 11431/76, U.S. Pat. Nos. 2,482,546, 2,596,926, and 3,582,346; polyalkyleneoxides as described in Japanese patent publication Nos. 16088/62 and 25201/67, U.S. Pat. No. 3,128,183, Japanese patent publication Nos. 11431/76 and 23883/67, and U.S. Pat. No. 3,532,501; and 1-phenyl-2-pyrazolidones, hydrazines, mesoionic type compounds, thione-type compounds, imidazoles and the like compounds. These compounds can be added to the developer, as the case may be. In particular, thioether-type compounds and 1-phenyl-3-pyrazolidones are preferred.

In the present invention, the color developers contain a bromide ion in an amount of $4\times10^{-3}$ mol/liter or less. Provided that the generation of fog can be prevented, the amount of the said bromide ion in the developer is preferably as small as possible in view of the acceleration of the development, is preferably $3\times10^{-3}$ mol/liter or less, is more preferably $2\times10^{-3}$ mol/liter, and is most preferably 0 mol/liter. Further, addition of an inorganic antifoggant, for example, a compound capable of imparting a chloride ion, such as NaCl or KCl, is preferred. A variety of organic antifoggants can desirably be added. Specific examples of such additives are set forth below, which, however, are not whatsoever limitative.

(1)

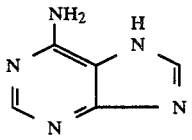

(2)

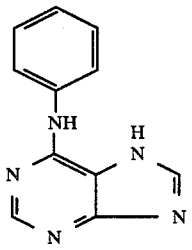

(3)

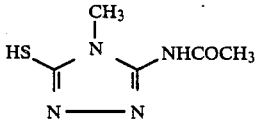

(4)

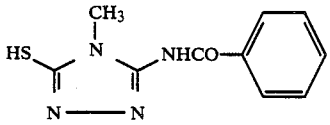

(5)

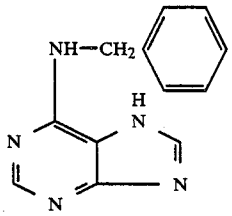

(6)

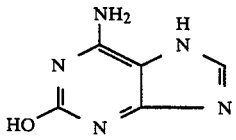

(7)

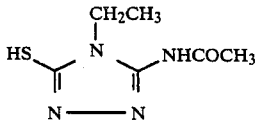

(8)

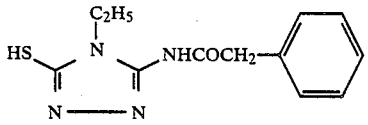

-continued (9)

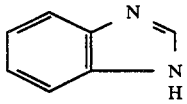

(10)

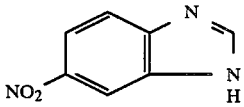

(11)

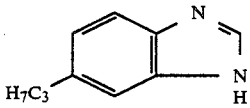

(12)

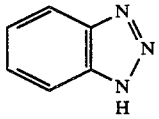

(13)

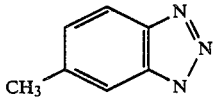

(14)

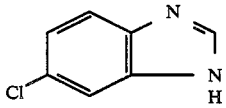

(15)

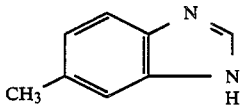

(16)

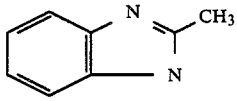

(17)

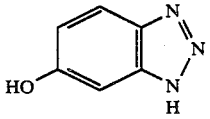

(18)

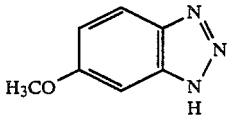

(19)

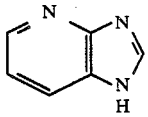

(20)

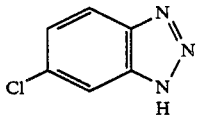

-continued
(21)
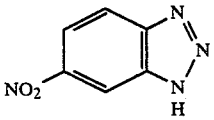
(22)
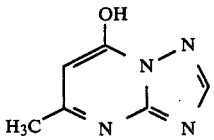
(23)
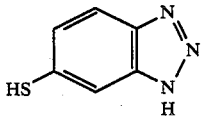
(24)
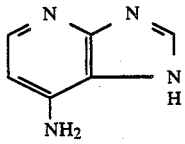
(25)
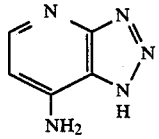
(26)
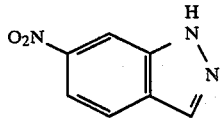
(27)
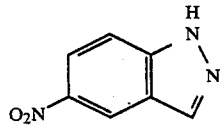
(28)
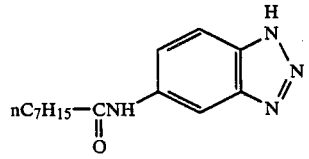
(29)
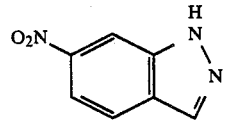
(30)
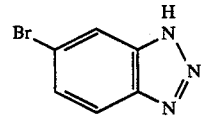
(31)
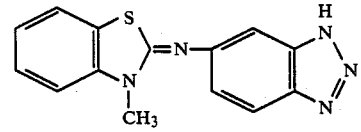
-continued
(32)
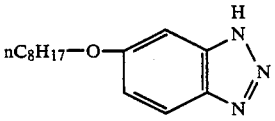
(33)
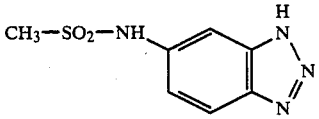
(34)
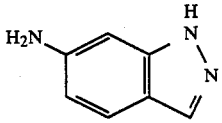
(35)
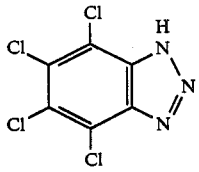
(36)
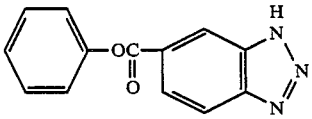
(37)
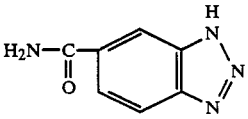
(38)
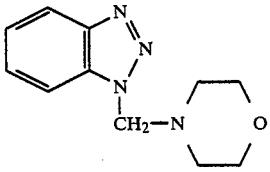
(39)
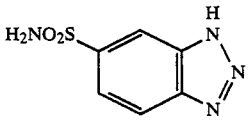
(40)
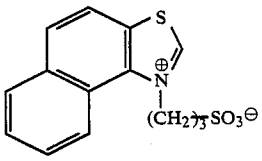
(41)
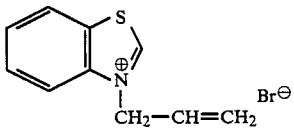
(42)
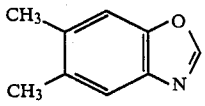

-continued
(43)
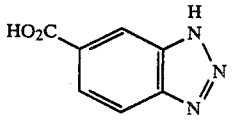
(44)
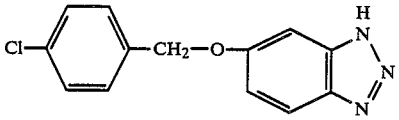
(45)
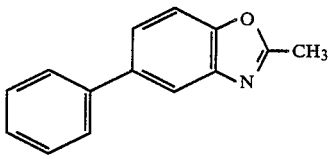
(46)
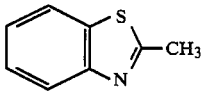
(47)
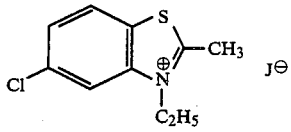
(48)
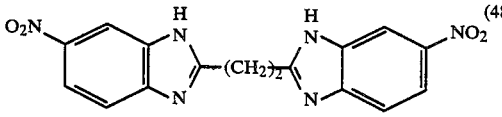
(49)
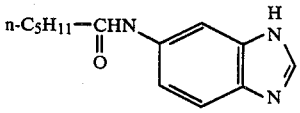
(50)
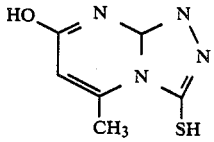
(51)
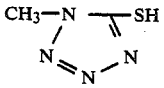
(52)
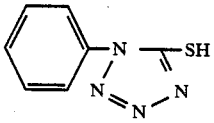
(53)
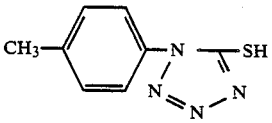
-continued
(54)
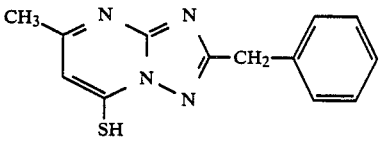
(55)
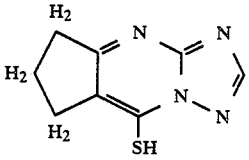
(56)
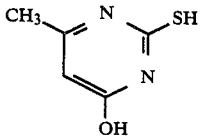
(57)
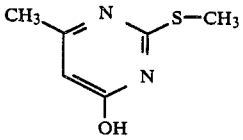
(58)
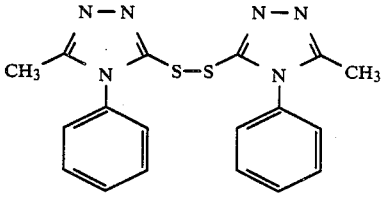
(59)
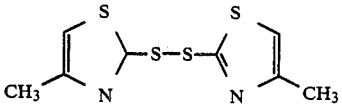
(60)
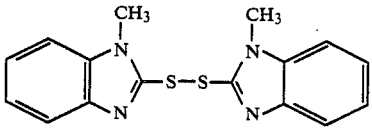
(61)
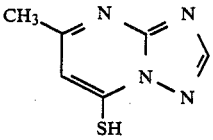
(62)
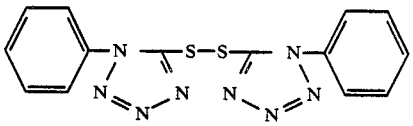
(63)
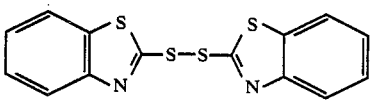
(64)
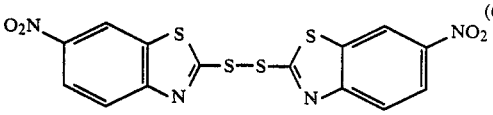

-continued
(65)
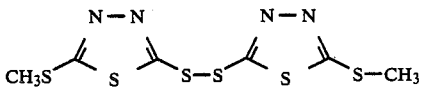
(66)
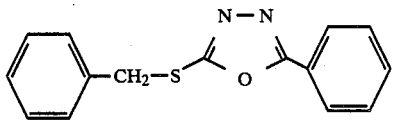
(67)
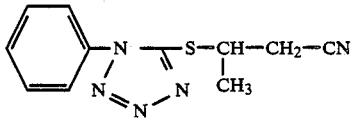
(68)
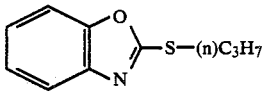
(69)
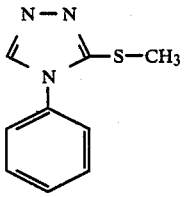
(70)
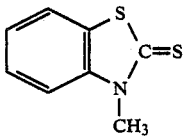
(71)
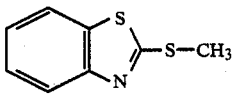
(72)
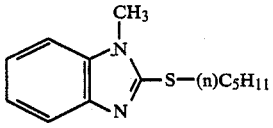
(73)
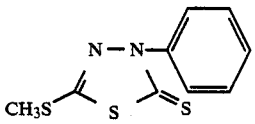
(74)
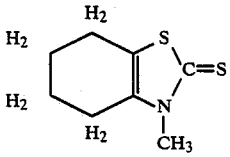
(75)
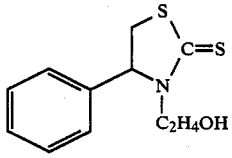
(76)
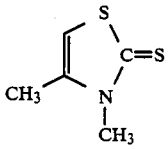
(77)
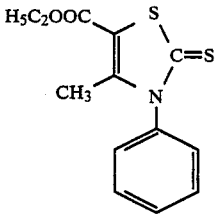
(78)
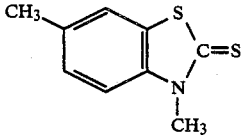
(79)
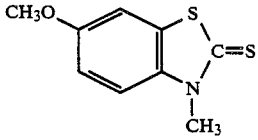
(80)
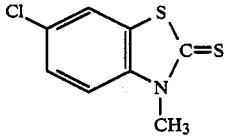
(81)
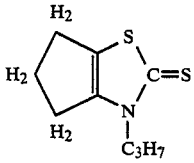
(82)
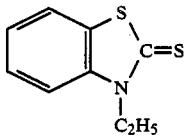
(83)
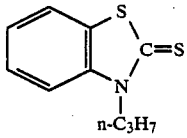
(84)
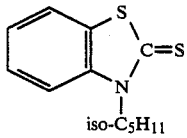

-continued
(85)
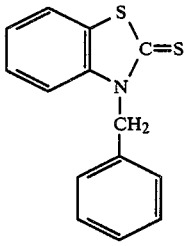
(86)
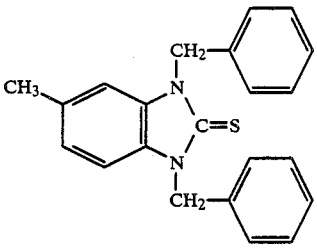
(87)
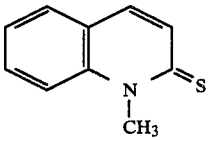
(88)
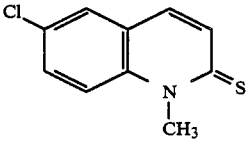
(89)
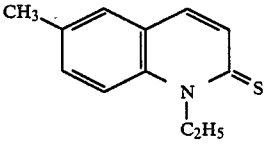
(90)
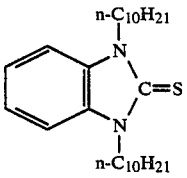
(91)
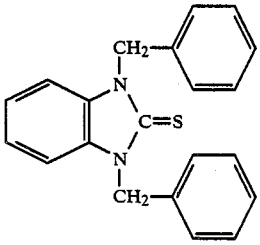
-continued
(92)
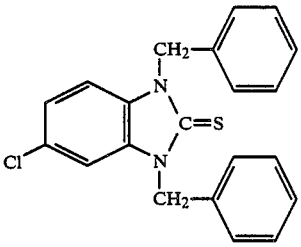
(93)
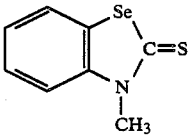
(94)
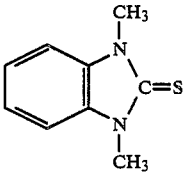
(95)
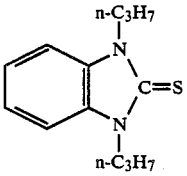
(96)
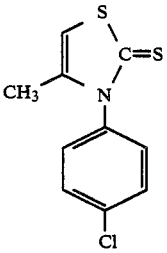
(97)
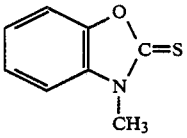
(98)
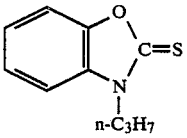
(99)
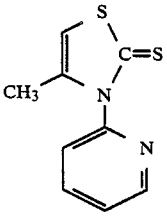

-continued
(100)
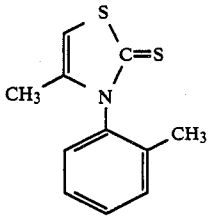
(101)
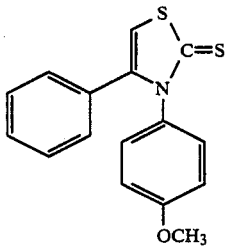
(102)
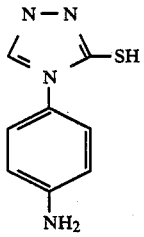
(103)
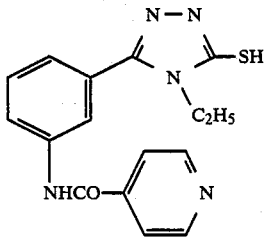
(104)
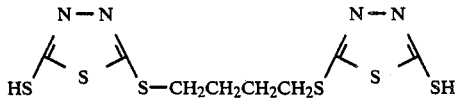
(105)
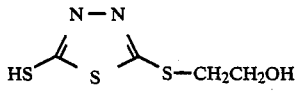
(106)
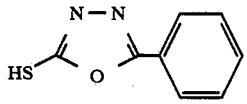
(107)
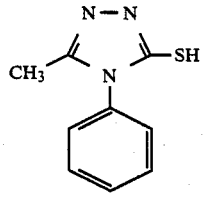
-continued
(108)
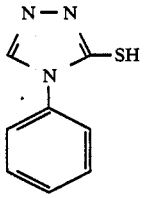
(109)
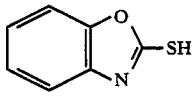
(110)
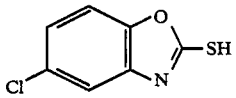
(111)
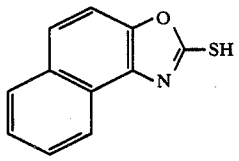
(112)
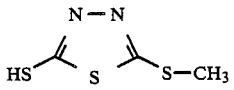
(113)
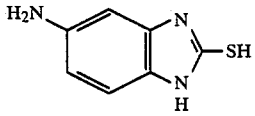
(114)
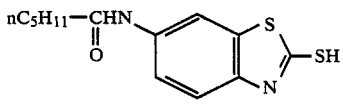
(115)
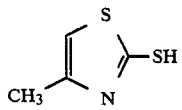
(116)
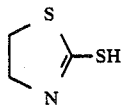
(117)
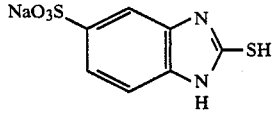
(118)
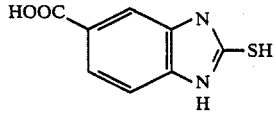

-continued
(119)
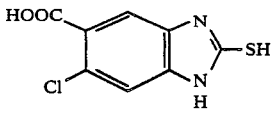
(120)
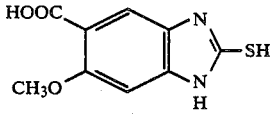
(121)
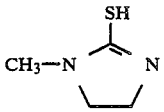
(122)
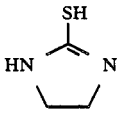
(123)
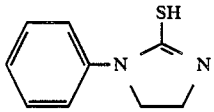
(124)
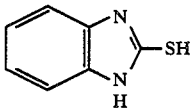
(125)
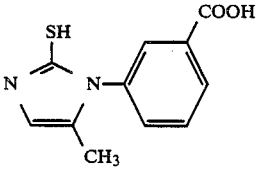
(126)
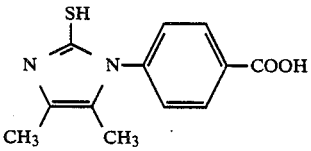
(127)
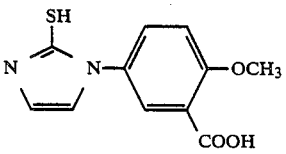
(128)
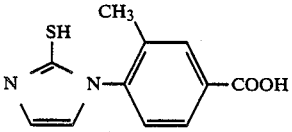
(129)
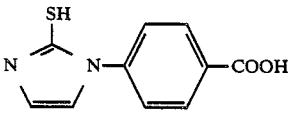
-continued
(130)
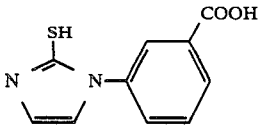
(131)
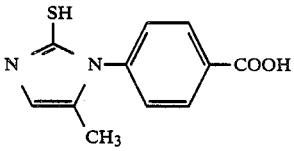
(132)
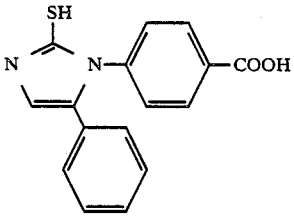
(133)
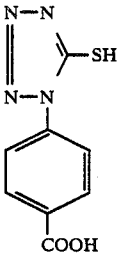
(134)
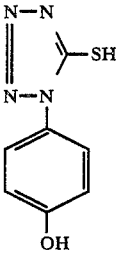
(135)
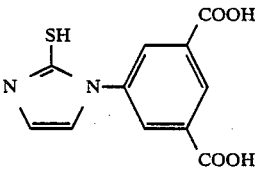
(136)
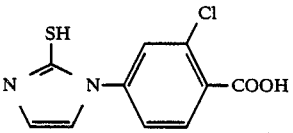
(137)
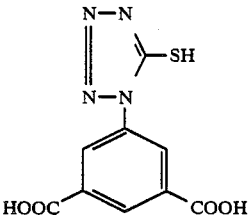

-continued (138)

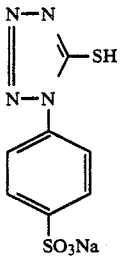

(139)

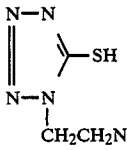

(140)

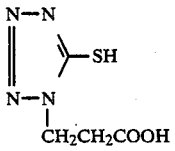

(141)

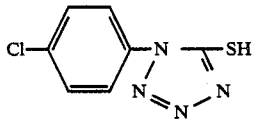

(142)

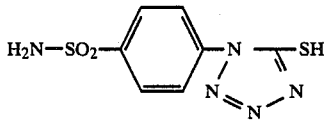

(143)

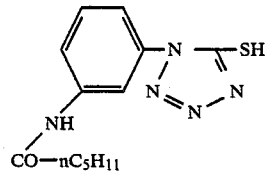

(144)

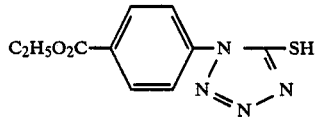

(145)

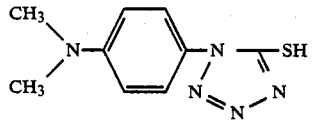

(146)

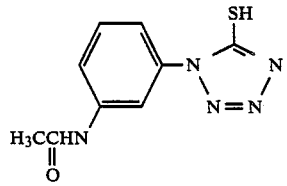

-continued (147)

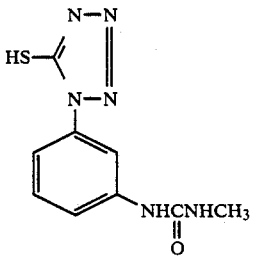

(148)

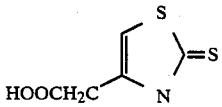

Of these antifoggants, (1), (3), (10), (13), (22), (146), (147) and (148) are particularly preferred.

The amount of these antifoggants to be added to the developers of the present invention should be as small as possible, provided that the amount is enough to prevent the generation of fog, and the amount is preferably from 0.01 to 1.0 g, and more preferably from 0.01 to 0.2 g, per liter of the color developer.

The antifoggant can be incorporated in the color photographic light-sensitive material in such manner that this may be dissolved out from the material during the processing thereof to thereby exist in the color developer.

The color developers of the present invention preferably contain a brightening agent. As the brightening agent, preferred are 4,4'-diamino-2,2'-disulfostilbene-type compounds. The amount thereof to be added to the developer is preferably up to 5 g/liter, and more preferably from 0.1 to 4 g/liter.

If desired, various kinds of surfactants can be added to the developer, including alkylsulfonic acids, arylsulfonic acids, aliphatic carboxylic acids, and aromatic carboxylic acids.

The processing temperature of the color developers of the present invention is preferably from 20° C. to 50° C., and more preferably from 30° C. to 40° C. The time for the color development is preferably from 20 seconds to 2 minutes, and more preferably from 30 seconds to one minute. The "time for the color development" means the time from the first contact of the photographic light-sensitive material to being processed with the color developer to the contact of the said material with the processing solution of the next bath, including the time for the transference of the material from the previous bath to the next bath (the so-called "transferring time").

The amount of the replenisher is preferably from 20 to 600 ml, more preferably from 50 to 300 ml, most preferably from 100 to 200 ml, per $m^2$ of the photographic light-sensitive material to be processed.

In the practice of the present invention, the photographic light-sensitive materials are subjected to bleach-fixing after the color development. The time for the bleach-fixing is preferably as short as possible, and is, for example, 1 minute and 30 seconds or less, particularly preferably 1 minute or less. The "time for the bleach-fixing" also means the time from the first contact of the photographic light-sensitive material as being processed with the bleach-fixing solution to the contact of said material with the washing water in the next bath, including the transferring time between the baths in addition to the time while the material is being dipped in the bleach-fixing bath.

The bleach-fixing solution to be used in the present invention contains, as a preservative, a compound capable of releasing a sulfite, such as sulfites (e.g., sodium sulfite, potassium sulfite, ammonium sulfite, etc.), bisulfites (e.g., ammonium bisulfite, sodium bisulfite, potassium bisulfite, etc.), meta-bisulfites (e.g., potassium meta-bisulfite, sodium meta-bisulfite, ammonium meta-bisulfite, etc.). The compound is preferably added to the bleach-fixing solution, in an amount of from about 0.01 to 0.50 mol/liter, more preferably from 0.10 to 0.20 mol/liter, in terms of the sulfite ion thereof.

Other preservatives which can be used in the present invention include bisulfite-adducts of hydroxylamine, hydrazine, or aldehyde compounds (for example, acetaldehyde, sodium bisulfite, ascorbic acid), etc.

Examples of the bleaching agents which can be used in the bleach-fixing bath of the present invention are iron(III)-organic complexes (for example, complexes with amino-polycarboxylic acids such as ethylenediamine-tetraacetic acid or diethylenetriamine-pentaacetic acid, amino-polyphosphonic acids, phosphonocarboxylic acids, and organic phosphonic acids); organic acids such as citric acid, tartaric acid or malic acid; persulfates; and hydrogen peroxide, etc. In particular, iron(III)-organic complexes are preferred, from the viewpoints of rapid processing and the prevention of environmental pollution. Examples of useful amino-polycarboxylic acids, amino-polyphosphonic acids, and organic phosphonic acids which can be used for the formation of iron(III)-organic complexes are set forth below.

Ethylenediamine-tetraacetic acid,
Diethylenetriamine-pentaacetic acid,
Ethylenediamine-N-(β-hydroxyethyl)-N,N',N'-triacetic acid,
1,3-diaminopropane-tetraacetic acid,
Triethylene-tetramine-hexaacetic acid,
Propylenediamine-tetraacetic acid,
Nitrilo-triacetic acid,
Nitrilo-tripropionic acid,
Cyclohexanediamine-tetraacetic acid,
1,3-diamino-2-propanol-tetraacetic acid,
Methylimino-diacetic acid,
Imino-diacetic acid,
Hydroxylimino-diacetic acid,
Dihydroxyethylglycine-ethylether-diamine-tetraacetic acid,
Glycolether-diamine-tetraacetic acid,
Ethylenediamine-tetrapropionic acid
Ethylenediamine-dipropionacetic acid,
Phenylenediamine-tetraacetic acid,
2-Phosphonobutane-1,2,4-triacetic acid,
1,3-diaminopropanol-N,N,N',N'-tetramethylene-phosphonic acid,
Ethylenediamine-N,N,N',N'-tetramethylene-phosphonic acid,
1,3-Propylenediamine-N,N,N',N'-tetramethylene-phosphonic acid,
1-hydroxyethylidene-1,1'-diphosphonic acid.

These compounds may be in the form of sodium, potassium, lithium, or ammonium salts. Among these compounds, iron (III) complex salts of ethylenediamine-tetraacetic acid, diethylenetriamine-pentaacetic acid, cyclohexanediamine-tetraacetic acid, 1,3-diaminopropane-tetraacetic acid, and methylimino-diacetic acid are preferred, as having high bleaching capacity.

The amount of the bleaching agent to be incorporated in the bleach-fixing solution is preferably from 0.15 to 0.5 mol, more preferably from 0.2 to 0.4 mol, per mol of the solution, for the purpose of the acceleration of the bleaching speed.

Any known fixing agents can be used in the bleach-fixing solution in the process of the present invention as the fixing agent component, that is, water-soluble silver halide solubilizing agents, including, for example, thiosulfates such as sodium thiosulfate and ammonium thiosulfates; thiocyanates such as sodium thiocyanate and ammonium thiocyanate; and thioether compounds such as ethylenebisthioglycolic acid, 3,6-dithia-1,8-octanediol, and thiourea compounds. These agents can be used singly or in the form of a mixture of two or more of them. In addition, a special bleach-fixing solution comprising the combination of a fixing agent and a large amount of a halide such as potassium iodide, as described in Japanese patent application (OPI) No. 155354/80, can also be used in the present invention. In the practice of the present invention, the use of thiosulfates, especially ammonium thiosulfate, is preferred.

The amount of the fixing agent in the bleach-fixing solution is preferably within the range of from 0.3 to 2 mols, more preferably from 0.5 to 1.0 mol, per liter of the solution.

The pH range of the bleach-fixing solution of the present invention is preferably within the range of from 4 to 8, particularly preferably from 5 to 7.5. If the pH of the solution is lower than that of said range, the deterioration of the solution and the formation of leuco dyes from cyan dyes are accelerated, although the efficiency for the removal of silver is improved. On the other hand, if the pH thereof is higher, the removal of silver is suppressed and the generation of stain is accelerated.

In order to adjust the pH value of the solution, hydrochloric acid, sulfuric acid, nitric acid, acetic acid, bicarbonates, ammonia, potassium hydroxide, sodium hydroxide, sodium carbonate, potassium carbonate, or the like can be added to the solution, if desired.

In addition, the bleach-fixing solution can further contain other various kinds of brightening agents, defoaming agents, or surfactants as well as organic solvents such as polyvinylpyrrolidone or methanol.

Further, the bleach-fixing solution can contain, if desired, a bleaching accelerator. Specific examples of useful bleaching accelerators include mercapto group- or disulfide group-containing compounds as described in U.S. Pat. No. 3,893,858, German Pat. Nos. 1,290,812 and 2,059,988, Japanese patent application (OPI) Nos. 32736/78, 57831/78, 37418/78, 65732/78, 72623/78, 95630/78, 95631/78, 104232/78, 124424/78, 141623/78 and 28426/78 and Research Disclosure, RD No. 17129 (July, 1978); thiazolidine derivatives as described in Japanese patent application (OPI) No. 140129/75; thiourea derivatives as described in Japanese patent publication Nos. 8506/70, 20832/77, and 32735/78, and U.S. Pat. No. 3,706,561; iodide compounds as described in German Pat. No. 1,127,715 and Japanese patent application (OPI) No. 16235/83; polyethyleneoxide compounds as described in German Pat. Nos. 966,410 and 2,748,430; polyamine compounds as described in Japanese Patent Publication No. 8836/70; and compounds as described in Japanese Patent Application (OPI) Nos. 42434/75, 59644/74, 94927/78, 35727/79, 26506/80, and 163940/83, and iodide or bromide ion, etc. In particular, mercapto group- or disulfide group-containing compounds are preferred, as having a high acceleration effect, among them; and especially, compounds as described in U.S. Pat. No. 3,893,858, German Pat. No. 1,290,812, and Japanese Patent Application (OPI) No. 95630/78 are more preferred.

Further, the bleach-fixing solution of the present invention may contain a re-halogenating agent selected from bromides such as potassium bromide, sodium bromide, and ammonium bromide, chlorides such as potassium chloride, sodium chloride, and ammonium chloride, and iodides such as ammonium iodide. If desired, the solution may further contain one or more organic acids and inorganic acids having a pH-buffering capacity and alkali metal or ammonium salts thereof, such as boric acid, borax, sodium metaborate, acetic acid, sodium acetate, sodium carbonate, potassium carbonate, phosphorous acid, phosphoric acid, sodium phosphate, citric acid, sodium citrate and tartaric acid, or a corrosion-inhibitor such as ammonium nitrate or guanidine, or a brightening agent.

The processing temperature in the bleach-fixing step in the method of the present invention is preferably from 10° C. to 50° C., and more preferably from 20° C. to 40° C. The amount of the replenisher is preferably from 20 to 600 ml, more preferably from 30 to 200 ml, per $m^2$ of the photographic light-sensitive material as being processed.

After the bleach-fixing step, the photographic light-sensitive materials are rinsed and/or subjected to stabilization treatment. In the rinsing and/or stabilization step in the method of the present invention, various kinds of compounds can be used for various purposes. For instance, addition of germicides or fungicides is known, for the purpose of preventing the propagation of various kinds of bacteria, fungi, and algae. For example, compounds as described in *J. Antibact. Antifung. Agents,* Vol. 11, No. 5, pp. 207–223 (1983); compounds as described in H. Horiguchi, *Antibacterial and Antifungal Chemistry;* and compounds as described in Japanese Patent Application (OPI) Nos. 8543/82, 58143/82, 97530/82, 105145/83, 134636/83, 91440/84, 126533/84, 184344/84, 185336/84, 239750/85, 239751/85, 247241/85, 260952/85, 2149/86, 28947/86, 28945/86, 267761/86 and 35446/86 can be used, and the means for the use of said compounds as described in the said publications can be adapted to the present invention. In particular, isothiazolone derivatives such as 2-octyl-4-isothiazolin-3-one, 5-chloro-2-methyl-4-isothiazolin-3-one, etc., sulfanylamide derivatives such as sulfanylamide, etc., and benzotriazole derivatives such as benzotriazole, 5-methyl-benzotriazole, 5-chlorobenzothiazole, etc., are useful. Addition of various kinds of chelating agents is further known, for the purpose of improving the image-stability after processing. For instance, inorganic phosphoric acids, organic carboxylic acids, aminopolycarboxylic acids and organic phosphonic acids are useful; and compounds and means for the use thereof, as described in Japanese Patent Application (OPI) Nos. 8543/82, 197540/82, 14834/83, 134636/83, 126533/84, 184343/84, 184344/84, 184345/84, 185336/84, 135942/85, 238832/85, 239748/85, 239749/85, 239750/85, 239751/85, 242458/85, 262161/85, 4047/86, 5050/86, 4051/86, 4052/86, 4053/86, 4054/86, 28942/86, and 28945/86, can be utilized. In particular, ethylenediamine-tetraacetic acid, diethylenetriamine-pentaacetic acid, nitrilo-triacetic acid, 1-hydroxyethylidene-1,1'-diphosphonic acid, and ethylenediaminetetramethylphosphonic acids are useful.

Metal compounds can be used in combination with the said chelating agents. For instance, bismuth compounds as described in Japanese Patent Application (OPI) No. 134636/83; Ba, Ca, Ce, Co, In, La, Mn, Ni, Pb, Ti, Sn, Zn, and Zr compounds as described in Japanese Patent Application (OPI) No. 184344/84; Mg, Al, or Sr compounds as described in Japanese Patent No. 185336/84, etc., can be used. In particular, Bi, Ca, Mg or Al compounds are especially useful.

In order to efficiently attain the rinsing in the process of the present invention, other various means can be adapted thereto, including a method of using a surfactant as described in Japanese Patent Application (OPI) No. 197540/82; a method of bringing into contact with an ion-exchange resin for the purpose of removing any harmful components which will cause some bad influence to the photographic materials as being processed as described in Japanese Patent Application (OPI) No. 220345/85, a method of reverse osmotic treatment as described in Japanese Patent Application (OPI) No. 241053/85; a method of bringing into contact with an active charcoal, a clay substance, a polyamide-type high molecular compound, a polyurethane-type high molecular compound, a phenol resin, an epoxy resin, a hydrazide group-containing high molecular compound, a polytetrafluoroethylene-containing high molecular compound, a monovalent or polyvalent alcohol-methacrylic acid monoester/polyvalent alcohol-methacrylic acid polyester copolymer as described in Japanese Patent Application (OPI) No. 263151/85 and a method of electrodialysis treatment as described in Japanese Patent Application (OPI) No. 28949/86.

Further, a method for irradiation of ultraviolet ray or for passing through a magnetic field is effective for the prevention of the propagation of bacteria or fungi.

In addition, means as described in Japanese Patent Application (OPI) Nos. 233651/85, 235133/85, 263941/85, 4048/86, 4049/86, 4055/86, 4056/86, 4057/86, 4058/86, and 4060/86 can also adapted to the present invention, in case the processing is to be carried out continuously.

Other brightening agents or hardeners can be added to the rinsing bath or stabilization bath, in addition to the above-mentioned additives.

Preferred is the addition of a variety of ammonium salts such as ammonium chloride, ammonium nitrate, ammonium sulfate, ammonium phosphate, ammonium sulfite, or ammonium thiosulfate as a film pH-adjusting agent for the photographic materials after processed, for the purpose of improving the storage stability of the formed images.

Regarding the addition of said additives, two or more of the same or different compounds can be used in combination in accordance with the object. Regarding the amount of the additives to be added, the amount is preferred to be the minimum one which is necessary for attaining the object, in view of the emulsion film property (such as tackiness) of the photographic light-sensitive materials after processed.

In the washing or stabilization step, a multistage countercurrent system having two or more processing tanks is preferred so as to minimize the amount of the replenisher solution to be added. The amount of the replenisher is preferably from 0.1 to 50 times, and more preferably from 3 to 30 times, to the amount of the processing solution as being carried from the previous bath, per the unit area of the photographic light-sensitive material as being processed.

The processing temperature in the rinsing or stabilization step in the method of the present invention is preferably from 20° C. to 45° C., more preferably from 25° C. to 40° C., and most preferably from 30° C. to 35° C.

The processing time is preferably 4 minutes or less, more preferably 2 minutes or less, and this is preferably as short as possible.

In order to accelerate the effect for washing out the components in the films in the rinsing and stabilization processing step, the processing solutions preferably circulated and stirred, and in particular, a means capable of strongly promoting liquid flow to the surface of the emulsion film of the photographic light-sensitive material being processed (for example, by gas-stirring or liquid-blowing) is especially preferred.

Each processing bath may be provided with a heater, a temperature sensor, a liquid surface level sensor, a circulation pump, a filter, a variety of floating lids, a variety of squeegee, a nitrogen stirrer, an air stirrer, etc., if desired.

The silver halide emulsions to be used in the present invention are silver chlorobromide or silver chloride, which does not substantially contain silver iodide; and the silver halide which is preferably used is silver chlorobromide having a composition of silver chloride content of more than 50 mol%.

The "silver halide which does not substantially contain silver iodide" as herein used means that the content of silver iodide in the composition is 1 mol% or less and preferably that the silver halide does not contain silver iodide at all. The silver chlorobromide to be used in the present invention preferably has a composition containing silver chloride in an amount of more than 50 mol%, and more preferably 60 mol% or more.

In order to obtain an emulsion having a sufficient sensitivity without increasing fog, the silver chloride content is preferably 80 mol% or less. However, the silver chloride content is often preferred to be 80 mol% or more, or 90 mol% or more, particularly in the case that rapid processing is required. In the case that the silver bromide content is made smaller, not only is rapid processing for the development step improved, but also the equilibrated deposited amount of the bromide ion, which is determined in relation to the amount of the replenisher, may exist in a lower concentration in the developer when the photographic light-sensitive mateerial containing the silver halide emulsion is processed with the processing solution by running treatment, and therefore, the rapid developability of the developer itself can be improved. Thus, low content of the silver bromide in the emulsion is preferred.

The silver chlorobromide color photographic materials of the present invention are can comprise two or more light-sensitive silver halide emulsion layers. At least one of these two or more light-sensitive silver halide emulsion layers is preferably a silver halide emulsion layer containing silver chlorobromide grains with the silver chloride content of more than 50 mol%. The silver halide composition in the other light-sensitive silver halide emulsion layers is not specifically limited, but preferably comprises silver chlorobromide grains or silver chloroiodide grains with the silver chloride content of at least 30 mol%. The amount of silver bromide and silver iodide in the silver chlorobromide color photographic light-sensitive materials is about 60 mol% or less, and preferably about 50 mol% or less, with respect to the total silver halide in the emulsion.

The silver halide grains for use in the present invention may differ in composition or phase between the inside and the surface layer thereof, may have a multiphase structure having a junction structure, or may have a uniform phase or composition throughout the whole grain. Also, the silver halide grains may be composed of a mixture of these grains having different phase structures.

The mean grain size (the diameter of the grain when the grain is spherical or resembles spherical, the mean value based on the project area using the edge length as the grain size when the grain is a cubic grain, or the diameter of the grain as the same as the spherical grain when the grain is a tabular grain) of the silver halide grains for use in the present invention is preferably from 0.1 μm to 2 μm, and more preferably from 0.15 μm to 1 μm.

The grain size distribution of a silver halide emulsion for use in the present invention may be narrow or broad, but a so-called monodispersed silver halide emulsion wherein the value (fluctuation) obtained by dividing the standard deviation in the grain distribution curve by the mean grain size is within about 20%, and preferably within 15%, is preferably used in the present invention. Also, for satisfying the gradation required for a color photographic material, two or more kinds of monodispersed silver halide emulsions (preferably having the above-described fluctuation as the monodispersibility) can exist in an emulsion layer having substantially the same color sensitivity as a mixture thereof or exist in two or more emulsion layers, respectively, each having substantially the same color sensitivity. Furthermore, two or more kinds of polydispersed silver halide emulsions or a combination of a monodispersed emulsion and a polydispersed emulsion can be used in one emulsion layer as a mixture thereof or in two or more layers, respectively.

The silver halide grains for use in the present invention may have a regular crystal form such as cubic, octahedral, dodecahedral, tetradecahedral, etc., or an irregular crystal form such as spherical, or further a composite form of these crystal forms. Also, a tabular grain silver halide emulsion can be used in the present invention. In particular, a tabular grain silver halide emulsion wherein tabular silver halide grains having an aspect ratio (length/width) of at least 5, in particular, at least 8, account for at least 50% of the total project area of the silver halide grains may be used. The silver halide emulsion for use in the present invention may be a mixture of these emulsions containing silver halide grains each having different crystal form. Also, the silver halide grains may be of a surface latent image type capable of forming latent images mainly on the surfaces thereof or of an internal image type capable of forming latent images mainly in the inside thereof.

The silver halide photographic emulsions for use in the present invention can be prepared using the methods described, for example, in P. Glafkides, *Chimie et Physique Photographique* (published by Paul Montel, 1967); G. F. Duffin, *Photographic Emulsion Chemistry* (published by Focal Press, 1966); V. L. Zelikman et al., *Making and Coating Photographic Emulsion* (published by Focal Press, 1964), etc.

For example, the silver halide emulsions may be prepared by an acid method, a neutralization method, an ammonia method, etc. Also, as a method of reacting a soluble silver salt and soluble halide(s), a single jet method, a double jet method, or a combination thereof may be used. A so-called reverse mixing method capable of forming silver halide grains in the existence of excessive silver ions can be employed. As one system of the double jet method, a so-called controlled double jet method of keeping a constant pAg in a liquid phase of forming silver halide grains can also be employed. According to the method, a silver halide emulsion containing silver halide grains having a regular crystal form and almost uniform grain sizes can be obtained.

Furthermore, a silver halide emulsion prepared by a so-called conversion method including a step of converting a silver halide already formed into a silver halide having a less solubility product before the formation step of the silver halide grains is finished or a silver halide emulsion prepared by applying the similar halogen conversion to silver halide grains after finishing the formation step of the silver halide grains can also be used.

The silver halide grains may also be formed, or physically ripened, in the presence of a cadmium salt, a zinc salt, a lead salt, a thallium salt, an iridium salt or a complex salt thereof, a rhodium salt or a complex salt thereof, an iron salt or a complex salt thereof, etc., for the various purposes of preventing the reciprocity law failure, obtaining a high sensitivity, controlling a gradation, etc., as described in U.S. Pat. Nos. 2,448,060, 2,628,167, 3,737,313, and 3,772,031, and *Research Disclosure,* Vol. 134, RD No. 13452 (June, 1975).

After the formation of silver halide grains, the silver halide emulsion thus obtained is usually subjected to physical ripening, subjected to desalting, and then subjected to chemical ripening before coating.

In this case, a silver halide solvent (e.g., ammonia, potassium rhodanate, and the thioethers and thione compounds described in U.S. Pat. No. 3,271,147, Japanese Patent Application (OPI) Nos. 12360/76, 82408/78, 144319/78, 100717/79, 155828/79, etc.) can be used for the precipitation, physical ripening, and chemical ripening of silver halide emulsions. For removing soluble salts from silver halide emulsion after physical ripening, a noodle washing method, a flocculation setting method, an ultrafiltration method, etc., can be used.

For the chemical sensitization of the silver halide emulsions for use in the present invention, a sulfur sensitization method using active gelatin or a sulfur-containing compound capable of reacting silver (e.g., thiosulfates, thioureas, mercapto compounds, rhodanines, etc.), a reduction sensitization method using a reducing material (e.g., stannous salts, amines, hydrazine derivatives, formamidinesulfinic acid, silane compounds, etc.), a noble metal sensitization method using a metal compound (e.g., gold complex salts and complex salts of metals belonging to group VIII of the Periodic Table, such as platinum, iridium, palladium, rhodium, iron, etc.) can be used individually or as a combination thereof.

The color photographic material which is processed by the process of the present invention has preferably at least one blue-sensitive emulsion layer, at least one green-sensitive emulsion layer and at least one red-sensitive emulsion layer, the silver halide emulsions of which are spectrally sensitized by methine dyes, etc., to have each color sensitivity. The dyes used for the purpose include cyanine dyes, merocyanine dyes, complex cyanine dyes, complex merocyanine dyes, halopolar cyanine dyes, hemicyanine dyes, styryl dyes, and hemioxonol dyes. The particularly useful dyes are cyanine dyes, merocyanine dyes and complex merocyanine dyes.

For these dyes can be applied various nuclei which are usually utilized for cyanine dyes as basic heterocyclic nuclei. That is, such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei obtained by fusing aliphatic hydrocarbon rings to these nuclei and the nuclei obtained by fusing aromatic hydrocarbon rings to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. Each of these nuclei may be substituted on the carbon atom of the dye.

For the merocyanine dyes or complex merocyanine dyes can be applied 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure.

The above-described sensitizing dyes can be used singly or as a combination thereof. A combination of sensitizing dyes is frequently used for the purpose of super color sensitization. Specific examples of the super color sensitizing dyes are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68, 12375/78, Japanese Patent Application (OPI) Nos. 110618/77, 109925/77, etc.

The silver halide emulsions for use in the present invention may further contain, together with the sensitizing dye(s), dyes having no spectral sensitizing action by themselves or materials which do not substantially absorb visible light but show supersensitizing action.

It is preferred that the couplers contained in the color photographic materials which are processed by the process of the present invention are nondiffusible due to having a ballast group or being polymerized.

Also, the use of 2-equivalent color couplers substituted by a releasable group can reduce the amount of silver for the color photographic materials as compared to 4-equivalent color couplers having a hydrogen atom at the coupling active group. Couplers giving colored dyes having a proper diffusibility, non-color-forming couplers, DIR couplers releasing a development inhibitor with coupling reaction, or DAR couplers releasing a development accelerator with coupling reaction can also be used in the present invention.

In the present invention, yellow couplers, magenta couplers (including the magenta couplers of formula (I) described hereinbefore), and cyan couplers can be used for the color photographic materials when the present invention is applied for multicolor photographic materials.

As the yellow couplers for use in the present invention, there are oil protect type acylacetamido couplers as the typical examples. Specific examples of these couplers are described in U.S. Pat. Nos. 2,407,210, 2,875,057, 3,265,506, etc. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom releasing type yellow couplers described in Japanese Patent Publication No. 10739/83, U.S. Pat. Nos. 4,401,752, 4,326,024, *Research Disclosure*, RD No. 18053 (April, 1979), British Pat. No. 1,425,020, West German Patent Application (OLS) Nos. 2,219,917, 2,261,361, 2,329,587, 2,433,812, etc. In these yellow couplers, α-pivaloylacetanilide couplers are excellent in fastness, in particular light fastness of colored dyes formed, while α-benzoylacetanilide couplers are excellent in coloring density.

In the present invention, the pyrazoloazole series magenta couplers represented by formula (I) described above may be used as the magenta couplers as described hereinbefore. Examples of the couplers include oil protect type indazolone series or cyanoacetyl series, and preferably 5-pyrazolone series magenta couplers and other pyrazoloazole series couplers such as pyrazoloazoles. As the 5-pyrazolone series magenta couplers which can be used together with or as a combination with the pyrazoloazole couplers of formula (I) described above, couplers substituted by an arylamino group or an acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,573, 3,062,653, 3,152,896, 3,936,015, etc. Also, as the releasable groups for the 2-equivalent 5-pyrazoline series couplers, the nitrogen atom-releasing groups described in U.S. Pat. No. 4,310,619 and the arylthio groups described in U.S. Pat. No. 4,351,897 are preferred. Furthermore, the 5-pyrazolone series magenta couplers having a ballast group described in European Pat. No. 73,636 give high coloring density.

As the pyrazoloazole type couplers, those of formula (I) are particularly preferred.

As the cyan couplers for use in the present invention, there are oil protect type naphthol series or phenol series couplers. Specific examples of the naphthol series couplers include the cyan couplers described in U.S. Pat. No. 2,474,293 and preferably the oxygen atom-releasing type 2-equivalent naphthol series couplers described in U.S. Pat. Nos. 4,052,212, 4,146,396, 4,228,233 and 4,296,200. Also, specific examples of the phenol series cyan couplers are described in U.S. Pat. Nos. 2,369,929, 2,801,171, 2,772,162, 2,894,826, etc. Cyan couplers having high fastness to humidity and temperature are preferably used in the present invention and typical examples of these cyan couplers include the phenol series cyan couplers having an alkyl group of 2 or more carbon atoms at the meta-position of the phenol nucleus described in U.S. Pat. No. 3,772,002, the 2,5-diacylamino-substituted phenol series cyan couplers described in U.S. Pat. Nos. 2,772,162, 3,758,308, 4,126,396, 4,334,011, 4,327,173, West German Patent Application (OLS) No. 3,329,729, Japanese Patent Application (OPI) No. 166956/84, etc., and the phenol series couplers having a phenylureido group at the 2-position thereof and an acylamino group at the 5-position thereof described in U.S. Pat. Nos. 3,446,622, 4,333,999, 4,451,559 and 4,427,767.

In the present invention, by using couplers giving colored dyes having a proper diffusibility together with the aforesaid color couplers, the graininess of color images formed can be improved. Specific examples of the magenta couplers giving such diffusible dyes are described in U.S. Pat. No. 4,366,237 and British Pat. No. 2,125,570 and specific examples of yellow, magenta and cyan couplers of this type are described in European Pat. No. 96,570 and West German patent application (OLS) No. 3,234,533.

The dye-forming couplers or the above-described specific couplers for use in the present invention may form dimers or higher polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

The various kinds of couplers for use in the present invention may be used for the same photographic layer of a color photographic material as a combination of two or more kinds thereof for meeting particular characteristics desired for a color photographic material, or the same kind of coupler may be used for two or more photographic layers for meeting desired characteristics.

The couplers for use in the present invention can be introduced into color photographic light-sensitive material by the oil-in-water dispersion method. According to the oil-in-water dispersion method, the coupler is first dissolved either in a single solution comprising one of high boiling point organic solvents having a boiling point of 175° C. or higher and so-called auxiliary solvents having a low boiling point or in a mixture solution comprising both types of solvents, and then the resulting solution is finely dispersed in an aqueous medium such as water or gelatin-aqueous solution in the presence of a surfactant. Examples of the high-boiling point organic solvents are described in U.S. Pat. No. 2,322,027. The dispersion may be accompanied by phase inversion. The auxiliary solvent as used may be removed or reduced by distillation, noddle washing, or ultrafiltration prior to coating the resulting emulsion onto a support.

Specific examples of the high-boiling point organic solvents include phthalates such as dibutyl phthalate, dicyclohexyl phthalate, di-2-ethylhexyl phthalate, decyl phthalate, etc., phosphates or phosphonates such as triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexyl-phenyl phosphonate, etc., benzoates such as 2-ethylhexyl benzoate, dodecyl benzoate, 2-ethylhexyl-p-hydroxybenzoate, etc., amides such as diethyldodecanamide, N-tetradecylpyrrolidone, etc., alcohols and phenols such as isostearyl alcohol, 2,4-di-tert-amylphenol, etc., aliphatic carboxylates such as dioctyl azelate, glycerol tributyrate, isostearyl lactate, trioctyl citrate, etc., aniline derivatives such as N,N-dibutyl-2-butoxy-5-tert-octylaniline, etc., hydrocarbons such as paraffin, dodecylbenzene, diisopropylnaphthalene, etc., etc. As the auxiliary solvent can be used organic solvents having a boiling point of about 30° C. or higher, and preferably from 50° C. to about 160° C., and typical examples thereof are ethyl acetate, butyl acetate, ethyl propionate, methylethylketone, cyclohexanone, 2-ethoxyethyl acetate, dimethylformamide, etc.

The means for the latex dispersion as well as the effect thereof and specific examples of latexes to be used for impregnation are described in U.S. Pat. No. 4,199,363, German Pat. (OLS) Nos. 2,541,274 and 2,541,230.

The standard amount of the color coupler is in the range of from 0.001 to 1 mol per mol of light-sensitive silver halide of a silver halide emulsion and the preferred amount is from 0.01 to 0.5 mol for yellow coupler, from 0.003 to 0.3 mol for magenta coupler, and form 0.002 to 0.3 mol for cyan coupler.

The color photographic materials for use in the present invention contain hydroquinone derivatives, aminophenol derivatives, amines, gallic acid derivatives, catechol derivatives, ascorbic acid derivatives, colorless compound-forming couplers, sulfonamidophenol derivatives, etc., as color fog preventing agents or color mixing preventing agents.

Also, the color photographic light-sensitive materials for use in the present invention may further contain organic anti-fading agents. Examples of such organic anti-fading agents include hindered phenols such as hydroquinones, 6-hydroxycoumarones, 5-hydroxycoumarans, spirochromans, p-alkoxyphenols, or bisphenols, gallic acid derivatives, methylenedioxybenzenes, aminophenols, hindered amines, and also the ether or ester derivatives obtained by silylating or alkylating the phenolic hydroxy groups of these compounds. Also, metal complexes such as (bissalicylaldoximate) nickel complex and (bis-N,N-dialkyldithiocarbamate) nickel complex can be used as anti-fading agent.

The use of the compound having both the moiety structure of hindered amine and hindered phenol in the same molecule as described in U.S. Pat. No. 4,268,593 for the color photographic materials give good results for preventing the deterioration of the yellow dye images by heat, humidity, and light. Also, for repreventing the deterioration of magenta dye images, particularly by light, the use of the spiroindanes described in Japanese patent application (OPI) No. 159644/81 or the chromans having a hydroquinone diether or monoether as a substituent described in Japanese patent application (OPI) No. 89835/80 gives preferred results.

For improving the stability of cyan images, in particular the light fastness thereof, it is preferred to use benzotriazole series ultraviolet absorbents for the color photographic materials. The ultraviolet absorbent may be co-emulsified with a cyan coupler.

The ultraviolet absorbent may be used in a coating amount sufficient for imparting light stability to the cyan dye images formed, but if too great of an amount of the agent is used, yellowing sometimes occurs at the unexposed portions (background portions) of color photographic light-sensitive material after processing, and hence the amount is in the range of usually from $1\times10^{-4}$ mol/m$^2$ to $2\times10^{-3}$ mol/m$^2$, preferably from $5\times10^{-4}$ to $1.5\times10^{-3}$ mol/m$^2$.

In an ordinary layer constitution of color photographic paper, an ultraviolet absorbent exists in one or preferably both layers disposed at both sides of a cyan coupler-containing red-sensitive silver halide emulsion layer. Also, when an ultraviolet absorbent is incorporated in an interlayer between a green-sensitive emulsion layer and a red-sensitive emulsion layer, the agent may be co-emulsified with a color mixing preventing agent. When an ultraviolet absorbent exists in a protective layer, another protective layer may be formed as the outermost layer and the protective layer may contain a matting agent, optionally having particle sizes. Moreover, the color photographic materials for use in the present invention may contain ultraviolet absorbents in hydrophilic colloid layers thereof.

Color photographic materials for use in the present invention may further contain water-soluble dyes in the hydrophilic colloid layers thereof as filter dyes or for the purposes of irradiation prevention, halation prevention, etc.

The color photographic materials for use in the present invention may further contain brightening agents such as stilbene series compounds, triazine series compounds, oxazole series compounds, coumarine series compounds, etc., in the photographic emulsion layers or other hydrophilic colloid layers. In this case, as the brightening agents, water-soluble brightening agents may be used or water-insoluble brightening agents may be used as a form of the dispersion thereof.

The processing process of the present invention can be applied to multilayer multicolor photographic materials having at least two photographic emulsion layers having different spectral sensitization on a support. A multilayer natural color photographic material usually has at least one red-sensitive emulsion layer, at least one green-sensitive emulsion layer, and at least one blue-sensitive emulsion layer on a support. The disposition order of these emulsion layers can be selected according to the intended use. For example, a red-sensitive emulsion layer, a green-sensitive emulsion layer, and a blue-sensitive emulsion layer can be coated on a support in this order. Alternatively, the red-sensitive emulsion layer can be exchanged by the blue-sensitive emulsion layer in the above-mentioned configuration. Also, each emulsion layer described above may be composed of two or more emulsion layers, each having different sensitivities. Also, a light-insensitive layer may exist between two or more emulsion layers each having the same color sensitivity.

It is preferred that the color photographic material for use in the present invention has proper auxiliary layers (also referred to as "photograph-constituting layers) such as a protective layer or protective layers, interlayers, a filter layer, an antihalation layer, a backing layer, etc., in addition to silver halide emulsion layers.

As the binder or protective colloid which can be used for the silver halide emulsion layers, interlayers, etc., of the color photographic materials in the present invention, gelatin is advantageously used, but other hydrophilic colloids can also be used.

For example, there are proteins such as gelatin derivatives, graft polymers of gelatin and other polymers, albumin, casein, etc.; cellulose derivatives such as hydroxyethyl cellulose, carboxymethyl cellulose, cellulose sulfates, etc.; saccharose derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, lime-processed gelatin as well as acid-processed gelatin or the enzyme-processed gelatin as described in *Journal of the Society of Photographic Science and Technology of Japan,* No. 16, p. 30 (1966) can be used. Also, the hydrolyzed products or enzyme decomposed products of gelatin can be used.

The color photographic materials for use in the present invention may further contain various stabilizers, stain preventing agents, developing agents or precursors thereof, development accelerators or precursors thereof, lubricants, mordants, matting agents, antistatic agents, plasticizers and other additives useful for the color photographic materials in addition to the above-described additives. Examples of these additives are described in *Research Disclosure,* RD No. 17643 (December, 1978) and ibid., RD No. 18716 (November, 1979).

The process of the present invention can preferably be applied to a color photographic material having a reflective support. The reflective support has a high reflectivity for clearly viewing dye images formed in silver halide emulsion layers of the color photographic material. Such a reflective support comprises a support coated with a hydrophobic resin having dispersed therein a light reflective material such as titanium oxide, zinc oxide, calcium carbonate, calcium sulfate, etc., and a support composed of a hydrophobic resin having dispersed therein a light reflective material as described above. Examples of the reflective support include baryta-coated papers, polyethylene-coated papers, polypropylene series synthetic papers, and transparent supports (e.g., glass plates, polyester films such as polyethylene terephthalate films, cellulose triacetate films, or cellulose nitrate films, polyamide films, polycarbonate films, polystyrene films, etc.) having a reflective layer or containing a reflective material. These supports can be appropriately selected according to the intended purposes.

The following examples are intended to illustrate the present invention but not to limit it in any way.

EXAMPLE 1

A multi-layer color photographic paper was prepared by forming the layers having the compositions shown below on a paper support both surfaces of which were coated with polyethylene. The coating compositions for the layers were prepared as follows.

Coating Composition for First Layer

In a mixture of 27.2 ml of ethyl acetate and 7.9 ml of Solvent (c) were dissolved 19.1 g of Yellow Coupler (a) and 4.4 g of Color Image Stabilizer (b) and the solution thus obtained was dispersed by emulsification in 185 ml of an aqueous 10 wt% gelatin solution containing 8 ml of a 10 wt% sodium dodecylbenzenesulfonate solution. On the other hand, 90 g of a silver chlorobromide emulsion (containing 80 mol% silver bromide and 70 g/kg of silver) containing the blue-sensitive sensitizing dye shown below in an amount of $7.0\times10^{-4}$ mol per mol of silver chlorobromide was prepared. The emulsified dispersion prepared above was mixed with the aforesaid silver halide emulsion and the gelatin concentration was adjusted as shown below to provide the coating composition fo the first layer. Coating compositions for the second layer to the seventh layer were also prepared by the same manner as in the first layer. As a gelatin hardening agent for each layer, 2,4-dichloro-6-hydroxy-s-triazine sodium salt was used.

The compositions of the layers were as follows. In addition, the polyethylene-coated paper contained titanium dioxide as a white pigment and ultramarine as a bluish dye.

First Layer: Blue-Sensitive Emulsion Layer

Mixed silver chlorobromide emulsion (silver bromide: 80 mol%): 0.30 g/m$^2$ as Ag (silver content)
Gelatin: 1.86 g/m$^2$
Yellow Coupler (a): 0.82 g/m$^2$
Color Image Stabilizer (b): 0.19 g/m$^2$
Solvent (c): 0.34 ml/m$^2$

Second Layer: Color Mixing Preventing Layer

Gelatin: 0.99 g/m$^2$
Color Mixing Preventing Agent (d): 0.08 g/m$^2$

Third Layer: Green-Sensitive Emulsion Layer

Mixed silver chlorobromide emulsion (shown in Table 1): 0.16 g/m$^2$ as Ag
Gelatin: 1.80 g/m$^2$
Magenta coupler (e): 0.34 g/m$^2$
Color Image Stabilizer (f): 0.20 g/m$^2$
Solvent (g): 0.68 ml/m$^2$

Fourth Layer: Ultraviolet Absorbing Layer

Gelatin: 1.60 g/m$^2$
Ultraviolet Absorbent (h): 0.62 g/m$^2$
Color Mixing Preventing Agent (i): 0.05 g/m$^2$
Solvent (j): 0.26 ml/m$^2$

Fifth Layer: Red-Sensitive Emulsion Layer

Mixed silver chlorobromide emulsion (silver bromide: 70 mol%): 0.26 g/m$^2$ as Ag
Gelatin: 0.98 g/m$^2$
Cyan Coupler (k): 0.38 g/m$^2$
Color Image Stabilizer (l): 0.17 g/m$^2$
Solvent (e): 0.23 ml/m$^2$

Sixth Layer: Ultraviolet Absorbing Layer

Gelatin: 0.54 g/m$^2$
Ultraviolet Absorbent (h): 0.21 g/m$^2$
Solvent (j): 0.09 ml/m$^2$

Seventh Layer: Protective Layer

Gelatin: 1.33 g/m$^2$
Acryl-modified copolymer of polyvinyl alcohol (modification degree of 17%): 0.17 g/m$^2$ As the spectral sensitizers for the respective emulsions, the following substances were used.

Blue-sensitive Emulsion Layer

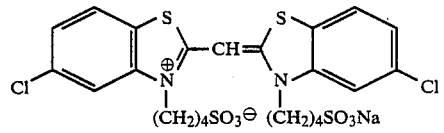

(Amount added: $7.0\times10^{-4}$ mol per mol of silver halide)

Green-sensitive Emulsion Layer

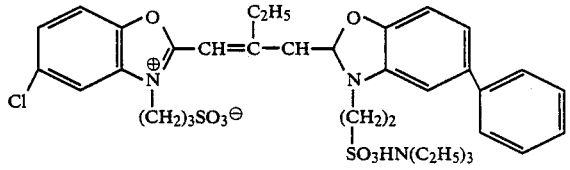

(Amount added: $4.0\times10^{-4}$ mol per mol of silver halide)

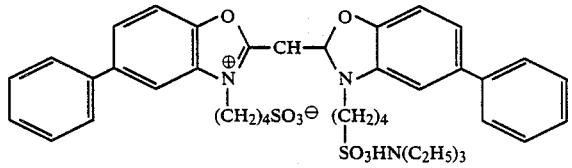

(Amount added: $7.0\times10^{-5}$ mol per mol of silver halide)

Red-sensitive Emulsion Layer

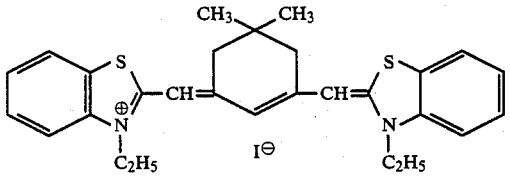

(Amount added: $1.0\times10^{-4}$ mol per mol of silver halide)

As the anti-irradiation dye for the respective emulsion layers, the following dyes were used.

Green-sensitive Emulsion Layer

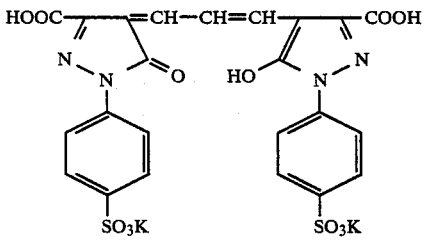

Red-sensitive Emulsion Layer

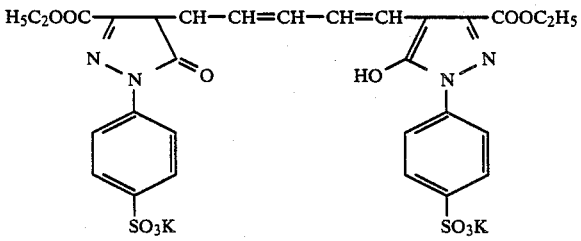

The compounds, including couplers, used in Example 1 have the following structural formulae.

Yellow coupler (a)

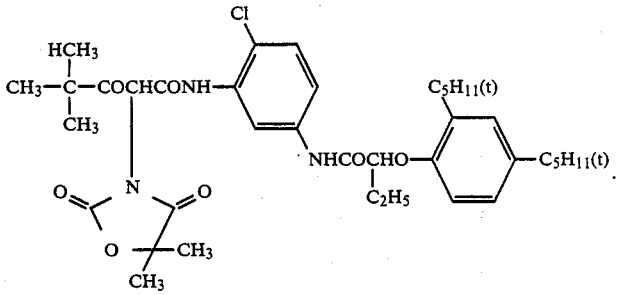

Color Image Stabilizer (b)

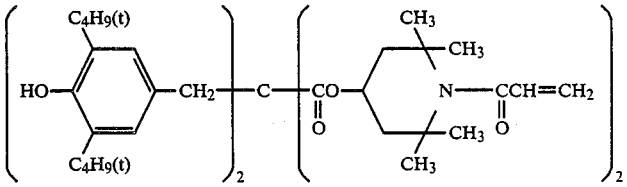

Solvent (c)

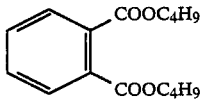

Color Mixing Preventing Agent (d)

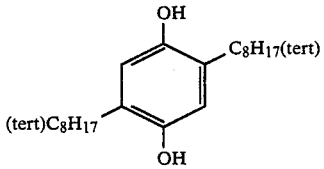

Magenta Coupler (e)

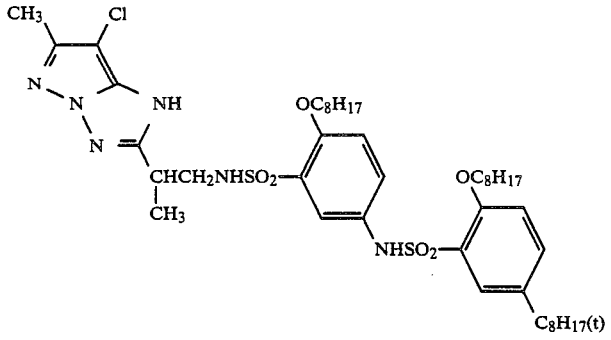

Color Image Stabilizer (f)

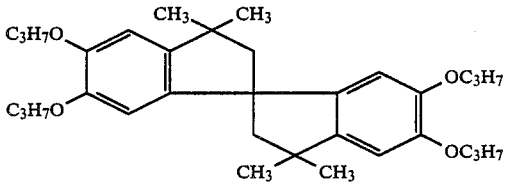

Solvent (g)

2/1 (by weight) mixture of the following compounds.

$(C_8H_{17}O)_3P{=}O$, and (

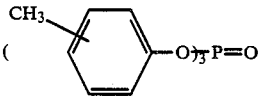

UV-Absorbent (h)

1/5/3 (by molar ratio) mixture of the following compounds.

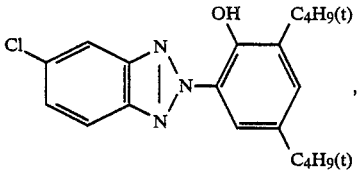

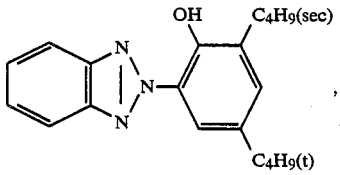

and

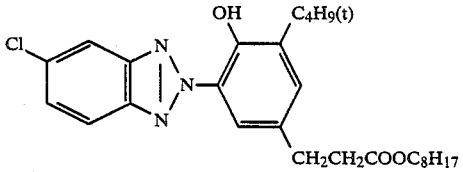

Color Mixing Preventing Agent (i)

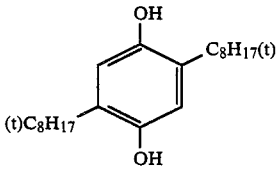

Solvent (j)

(iso $C_9H_{19}O)_3P{=}O$

Cyan Coupler (k)

1/1 (by molar ratio) mixture of the following compounds.

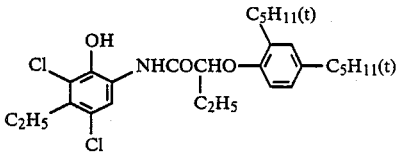

(k1)

and

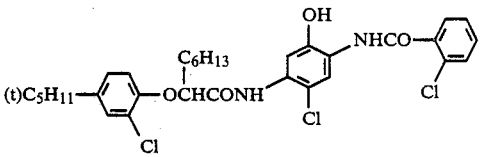

(k2)

Color Image Stabilizer (l)

1/3/3 (by molar ratio) mixture of the following compounds.

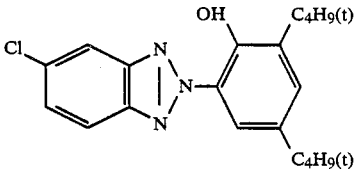

-continued

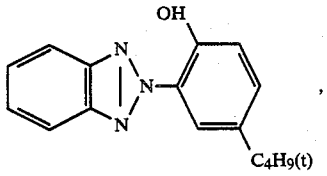

and

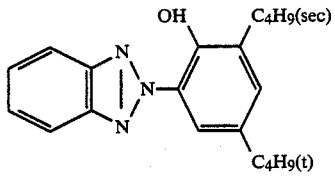

Solvent (m)

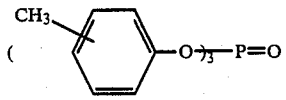

-continued

| | |
|---|---|
| Diethylene Glycol | See Table 1 |
| Sodium Sulfite | 1.5 g |
| Hydroxylamine Sulfate | 1.0 g |
| Potassium Carbonate | 35 g |
| N—methyl-N—(β-methanesulfonamido-ethyl)-3-methyl-4-aminoaniline Sulfate | 4.5 g |
| Brightening Agent (4,4'-diaminostylbene-type) | 1.0 g |
| Potassium Bromide | See Table 1 |
| Water to make | 1000 ml |
| KOH to make | pH 10.20 |
| Bleach-fixing Solution | |
| Water | 400 ml |
| Ammonium Thiosulfate (70 wt %) | 150 ml |
| Sodium Sulfite | 18 g |
| Ammonium Ethylenediamine-tetraacetic Acid Iron (III) | 55 g |
| Ethylenediaminetetraacetic Acid | 5 g |
| Water to make | 1000 ml |
| | pH 6.75 |

The minimum density (Dmin) and the maximum density (Dmax) of the green color in the thus processed photographic paper were measured by Macbeth Densitometer, and the results obtained are set forth in the following Table 1.

TABLE 1

| No. | Silver Chlorobromide Composition (Silver Chloride mol %) | KBr Concentration in Color Developer (mol/liter) | Added Amount of Benzyl Alcohol/ Diethylene Glycol (ml/liter) | Note | Density 45 sec Dmin | 45 sec Dmax | 2 min Dmin | 2 min Dmax | 3 min 30 sec Dmin | 3 min 30 sec Dmax |
|---|---|---|---|---|---|---|---|---|---|---|
| 1 | 30 | $5 \times 10^{-3}$ | 15 / 10 | Comparison | 0.12 | 1.80 | 0.14 | 2.00 | 0.16 | 2.20 |
| 2 | 60 | $5 \times 10^{-3}$ | 15 / 10 | " | 0.13 | 1.95 | 0.16 | 2.10 | 0.24 | 2.21 |
| 3 | 80 | $5 \times 10^{-3}$ | 15 / 10 | " | 0.15 | 2.00 | 0.20 | 2.21 | 0.28 | 2.23 |
| 4 | 30 | $5 \times 10^{-3}$ | — | " | 0.12 | 1.63 | 0.13 | 1.84 | 0.13 | 2.01 |
| 5 | 80 | $5 \times 10^{-3}$ | — | " | 0.13 | 1.85 | 0.14 | 2.10 | 0.15 | 2.15 |
| 6 | 70 | $4 \times 10^{-3}$ | 15 / 10 | " | 0.14 | 2.10 | 0.17 | 2.21 | 0.19 | 2.23 |
| 7 | 80 | — | 6 / 6 | " | 0.15 | 2.18 | 0.19 | 2.20 | 0.24 | 2.24 |
| 8 | 60 | $4 \times 10^{-3}$ | 6 / 6 | " | 0.14 | 2.12 | 0.17 | 2.16 | 0.19 | 2.19 |
| 9 | 30 | $2 \times 10^{-3}$ | 3 / 0 | " | 0.13 | 1.99 | 0.15 | 2.09 | 0.17 | 2.20 |
| 10 | 30 | — | — | " | 0.12 | 1.98 | 0.12 | 2.07 | 0.14 | 2.16 |
| 11 | 30 | $4 \times 10^{-3}$ | — | " | 0.12 | 1.95 | 0.12 | 2.05 | 0.13 | 2.15 |
| 12 | 60 | — | — | Invention | 0.12 | 2.12 | 0.12 | 2.17 | 0.14 | 2.20 |
| 13 | 60 | $2 \times 10^{-3}$ | — | " | 0.12 | 2.10 | 0.12 | 2.19 | 0.15 | 2.21 |
| 14 | 60 | $4 \times 10^{-3}$ | — | " | 0.12 | 2.08 | 0.12 | 2.21 | 0.15 | 2.23 |
| 15 | 80 | — | — | " | 0.12 | 2.14 | 0.12 | 2.22 | 0.18 | 2.24 |
| 16 | 80 | $2 \times 10^{-3}$ | — | " | 0.12 | 2.12 | 0.12 | 2.21 | 0.16 | 2.22 |
| 17 | 80 | $4 \times 10^{-3}$ | — | " | 0.12 | 2.10 | 0.12 | 2.20 | 0.14 | 2.21 |
| 18 | 100 | — | — | " | 0.12 | 2.19 | 0.14 | 2.22 | 0.19 | 2.26 |
| 19 | 100 | $4 \times 10^{-3}$ | — | " | 0.12 | 2.16 | 0.13 | 2.19 | 0.16 | 2.23 |

The multilayer color photographic paper prepared as above was, after being exposed, processed in accordance with the following processing steps:

| Processing Step | Temperature | Time |
|---|---|---|
| Color Development | 35° C. | 45 sec, 1 min, and 3 min 30 sec |
| Bleach-fixing | 35° C. | 45 sec |
| Rinsing (washing in water) | 35° C. | 1 min 30 sec |
| Drying | 80° C. | 1 min 00 sec |

The processing solutions used had the following compositions:

| Color Developer | |
|---|---|
| Water | 800 ml |
| Diethylenetriamine-pentaacetic Acid | 2.0 g |
| Benzyl Alcohol | See Table 1 |

The results in Table 1 prove the following facts: In the comparative examples where the processing was carried out in the presence of benzyl alcohol (Nos. 1, 2, 3, 6, 7, 8, and 9), the fog increased with increase of the developing time, whereas the processing in the absence of benzyl alcohol resulted in the failure of color forming property in the short color development time under the condition of the high bromide ion concentration (Nos. 4 and 5).

In the present invention, on the other hand, the increment of the fog was reduced in the development time of 2 minutes or less, and the color forming property was excellent. In particular, the cases where the silver chloride content was from 60 to 80 mol% were especially excellent (Nos. 12, 13, 14, 15, 16, and 17).

Further, in case the bromide ion concentration was $4 \times 10^{-3}$ mol/liter or less, the above-mentioned effect of the present invention was remarkable, which was apparent, for example, in comparison of No. 5 with Nos. 16 and 17 with respect to the values of Dmin and Dmax.

EXAMPLE 2

The same treatment as Example 1 was carried out, except that the following magenta couplers (O), (P), (Q), and (R) were used in place of the magenta coupler (e) in the Example 1. And then Dmin and Dmax of the resulting magenta colors were measured. The results obtained are set forth in the following Table 2.

Magenta Coupler (O)

(the coated silver amount in the third layer was 0.35 g/m$^2$)

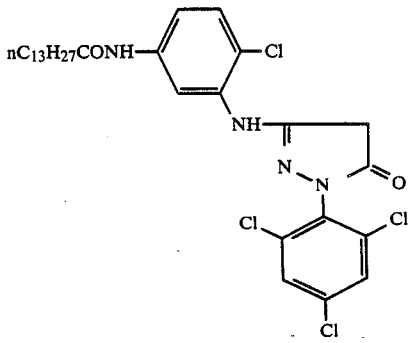

Magenta Coupler (P)

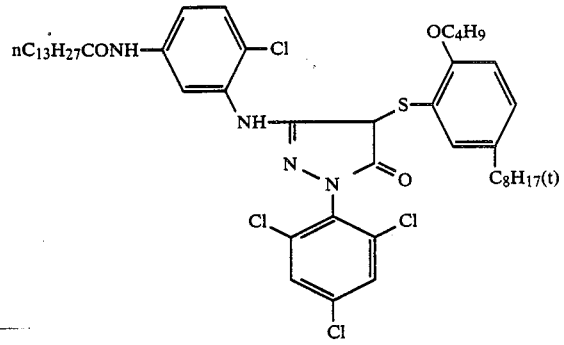

Magenta Coupler (Q)

The afore-listed Compound M-55.

Magenta Coupler (R)

The afore-listed Compound M-57.

TABLE 2

| No. | Magenta Coupler | Silver Chlorobromide Composition (Silver Chloride mol %) | Concentration in Color Developer (mol/liter) | Added Amount of Benzyl Alcohol/ Diethylene Glycol (ml/liter) | Note | Density 45 sec Dmin | Density 45 sec Dmax | Density 2 min Dmin | Density 2 min Dmax | Density 3 min 30 sec Dmin | Density 3 min 30 sec Dmax |
|---|---|---|---|---|---|---|---|---|---|---|---|
| 20 | O | 60 | $5 \times 10^{-3}$ | 15 / 10 | Comparison | 0.12 | 1.61 | 0.14 | 1.88 | 0.16 | 2.21 |
| 21 | P | " | " | " | " | 0.12 | 1.83 | 0.16 | 2.05 | 0.20 | 2.25 |
| 22 | Q | " | " | " | " | 0.12 | 1.82 | 0.14 | 2.02 | 0.17 | 2.21 |
| 23 | R | " | " | " | " | 0.12 | 1.72 | 0.13 | 1.91 | 0.15 | 2.13 |
| 24 | O | 80 | $2 \times 10^{-3}$ | 6 / 6 | " | 0.14 | 2.10 | 0.17 | 2.21 | 0.18 | 2.25 |
| 25 | P | " | " | " | " | 0.15 | 2.21 | 0.22 | 2.24 | 0.25 | 2.26 |
| 26 | Q | " | " | " | " | 0.13 | 2.18 | 0.16 | 2.21 | 0.19 | 2.22 |
| 27 | R | " | " | " | " | 0.13 | 2.17 | 0.16 | 2.20 | 0.20 | 2.21 |
| 28 | O | 60 | $3 \times 10^{-3}$ | — | Invention | 0.12 | 1.95 | 0.12 | 2.10 | 0.14 | 2.21 |
| 29 | P | " | " | — | " | 0.13 | 2.13 | 0.15 | 2.20 | 1.17 | 2.24 |
| 30 | Q | " | " | — | " | 0.12 | 2.08 | 0.12 | 2.20 | 0.15 | 2.22 |
| 31 | R | " | " | — | " | 0.12 | 2.10 | 0.12 | 2.22 | 0.15 | 2.23 |
| 32 | O | 80 | $2 \times 10^{-3}$ | — | " | 0.12 | 1.99 | 0.13 | 2.14 | 0.16 | 2.20 |
| 33 | P | 80 | $2 \times 10^{-3}$ | — | Invention | 0.13 | 2.20 | 0.15 | 2.21 | 0.19 | 2.25 |
| 34 | Q | " | " | — | " | 0.12 | 2.14 | 0.12 | 2.21 | 0.16 | 2.24 |
| 35 | R | " | " | — | " | 0.12 | 2.16 | 0.12 | 2.22 | 0.17 | 2.22 |

The results in Table 2 proves the following facts: In the comparative examples by the processing in the presence of benzyl alcohol, the increment of the fog was noticeable, while in the present invention almost no increment of the fog was noted in the color development for 2 minutes or less and the color forming property was excellent. In particular, the cases where the pyrazoloazole coupler was used as the magenta coupler (Nos. 30, 31, 34, and 35) were excellent in that the fog was less and the color forming property was good.

EXAMPLE 3

The color photographic paper of Example 1 was processed by the following processing procedure in place of the processing of the Example 1.

| Processing Step | Temperature | Time |
|---|---|---|
| Color Development | 35° C. | 45 sec |
| Bleach-fixing | 35° C. | 45 sec |
| Rinsing (1) | 35° C. | 20 sec |
| Rinsing (2) | 35° C. | 20 sec |
| Rinsing (3) | 35° C. | 20 sec |
| Rinsing (4) | 35° C. | 30 sec |

-continued

| Processing Step | Temperature | Time |
|---|---|---|
| Drying | 80° C. | 60 sec |

The rinsing solution flow was a countercurrent system of from (4) to (3) to (2) to (1). The composition of the color developer and the bleach-fixing solution were same as those of the Example 1.

The composition of the rinsing solution was as follows.

| Rinsing Solution | |
|---|---|
| 1-Hydroxyethylidene-1,1'-diphosphonic Acid (60 wt %) | 1.6 ml |
| Ethylenediamine-N,N,N',N'—tetra-methylenephosphonic Acid | 0.5 g |
| Bismuth Chloride | 0.35 g |
| Polyvinyl Pyrrolidone | 0.25 g |
| Aqueous Ammonia (26 wt %) | 2.5 ml |
| 3Na.nitrilo-triacetate | 1.0 g |
| EDTA.4H | 0.5 g |
| Sulfanylamide | 100 mg |
| Sodium Sulfite | 1.0 g |
| Benzotriazole | 0.5 g |
| 5-Chloro-2-methyl-4-isothiazolin-3-one | 50 mg |
| 2-Octyl-4-isothiazolin-3-one | 50 mg |
| Brightening Agent (4,4'-diamino-stylbene-type) | 1.0 g |
| Water to make | 1000 ml |
| Potassium hydroxide to make | pH 7.5 |

In the same manner as the Example 1, Dmin and Dmax were measured. As a result, the processing with the color developer containing $4\times10^{-3}$ mol/liter or less of potassium bromide, and not containing benzyl alcohol, in accordance with the present invention, showed the same excellent photographic characteristics as those of the Example 1.

EXAMPLE 4

The first layer (lowermost layer) to the seventh layer (uppermost layer) were coated on a polyethylene laminate-duplicated paper which had been treated by corona-discharge, to obtain the sample No. 44.

The coating solution of the first layer was prepared as follows: Specifically, a mixture comprising 200 g of the yellow coupler, 93.3 g of the anti-fading agent, 10 g of the high boiling point solvent (p), and 5 g of the high boiling point solvent (q), and additionally containing 600 ml of ethyl acetate as an auxiliary solvent, as shown below, was heated at 60° C. and dissolved, and then, the resulting solution was admixed with 3300 ml of gelatin-aqueous solution containing 330 ml of 5 wt% aqueous solution of Alkanol B (alkyl naphthalene-sulfonate, manufactured by du Pont Co.) and emulsified by the use of a colloid mill to obtain a coupler-containing dispersion. The ethyl acetate was distilled out from the dispersion under reduced pressure, and the resulting dispersion was added to 1400 g of an emulsion to which the sensitizing dye for the blue-sensitive emulsion layer and 1-methyl-2-mercapto-5-acetylamino-1,3,4-triazole had been added, said emulsion containing 96.7 g of Ag and 170 g of gelatin, and then 2600 g of 10 wt% gelatin aqueous solution was added thereto, to obtain the coating solution.

The other coating solutions of the 2nd to 7th layers were prepared in accordance with the coating solution of the 1st layer.

The composition of the layers were as follows:

Support

Polyethylene Lamiante-duplicated Paper Support

First Layer: Blue-Sensitive Emulsion Layer

Silver Chlorobromide Emulsion (silver bromide: 5 mol%): 290 mg/m$^2$
Yellow coupler: 600 mg/m$^2$
Anti-fading Agent (r): 280 mg/m$^2$
Solvent (p): 30 mg/m$^2$
Solvent (q): 15 mg/m$^2$
Gelatin: 1800 mg/m$^2$ Second Layer: Color Mixing Preventing Layer Silver Bromide Emulsion (Primitive emulsion grain size: 0.05 μm): 10 mg (Ag)/m$^2$
Color Mixing Preventing Agent (s): 55 mg/m$^2$
Solvent (p): 30 mg/m$^2$
Solvent (q): 15 mg/m$^2$
Gelatin: 800 mg/m$^2$ Third Layer: Green-Sensitive Emulsion Layer Silver Chlorobromide Emulsion (silver bromide: 3 mol%): 305 mg/m$^2$
Magenta Coupler: 670 mg/m$^2$
Anti-fading Agent (t): 150 mg/m$^2$
Anti-fading Agent (u): 10 mg/m$^2$
Solvent (p): 200 mg/m$^2$
Solvent (q): 10 mg/m$^2$
Gelatin: 1400 mg/m$^2$ Fourth Layer: Color Mixing Preventing Layer Color Mixing Preventing Agent: 65 mg/m$^2$
UV-Absorbent (n): 450 mg/m$^2$
UV-Absorbent (o): 230 mg/m$^2$
Solvent (p): 50 mg/m$^2$
Solvent (q): 50 mg/m$^2$
Gelatin: 1700 mg/m$^2$ Fifth Layer: Red-Sensitive Emulsion Layer Silver Chlorobromide Emulsion (silver bromide: 1 mol%): 210 mg/m$^2$
Cyan Coupler (C-2): 260 mg/m$^2$
Cyan Coupler (C-1): 120 mg/m$^2$
Anti-fading Agent (r): 250 mg/m$^2$
Solvent (p): 160 mg/m$^2$
Solvent (q): 100 mg/m$^2$
Gelatin: 1800 mg/m$^2$ Sixth Layer: UV-Absorbing Layer UV-Absorbent (n): 260 mg/m$^2$
UV-Absorbent (o): 70 mg/m$^2$
Solvent (p): 300 mg/m$^2$
Solvent (q): 150 mg/m$^2$
Gelatin: 700 mg/m$^2$ Seventh Layer: Protective Layer Gelatin: 600 mg/m$^2$ Notes:

UV-absorbent (n): 2-(2-hydroxy-3,5-di-tert-amylphenyl)-benzotriazole

UV-absorbent (o): 2-(2-hydroxy-3,5-di-tert-butylphenyl)-benzotriazole

Solvent (p): di(2-ethylhexyl)phthalate

Solvent (q): dibutyl phthalate

Anti-fading Agent (r): 2,5-di-tert-amylphenyl-3,5-di-tert-butyl hydroxybenzoate

Color Mixing Preventing Agent (s): 2,5-di-tert-octylhydroquinone

Anti-fading Agent (t): 1,4-di-tert-amyl-2,5-dioctyloxybenzene

Anti-fading Agent (u): 2,2'-methylenebis(4-methyl-6-

Blue-Sensitive Emulsion Layer anhydro-5-methoxy-5'-methyl-3,3'-disulfopropylselenacyanine-hydroxide.

Green-Sensitive Emulsion Layer anhydro-9-ethyl-5,5'-diphenyl-3,3'-disulfoethyloxacarbocyanine-hydroxide.

Red-Sensitive Emulsion Layer 3,3'-diethyl-5-methoxy-9,9'-(2,2-dimethyl-1,3-propano)thiadicarbocyanine-iodide.

The stabilizer as used in each emulsion layer was as follows:

1-Methyl-2-mercapto-5-acetylamino-1,3,4-triazole.

The following substances were used as the anti-irradiation dye:

Dipotassium 4-(3-carboxy-5-hydroxy-4-(3-(3-carboxy-5-oxo-1-(4-sulfonatophenyl)-2-pyrazolin-4-ylidene-1-propenyl)-1-pyrazolyl)benzenesulfonate.

Tetrasodium N,N'-(4,8-dihydroxy-9,10-dioxo-3,7-disulfonatoe-anthracene-1,5-diyl)-bis(aminomethanesulfonate).

As the hardener, 1,2-bis(vinylsulfonyl)ethane was used. The couplers as used were as follows.

Yellow Coupler

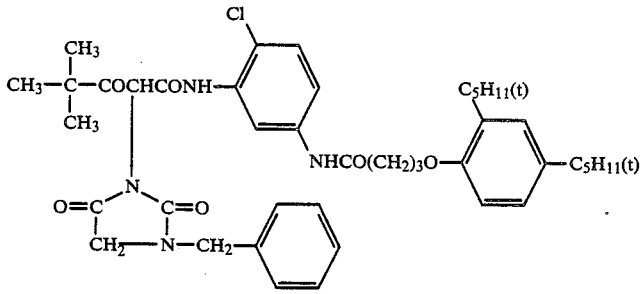

Magenta Coupler

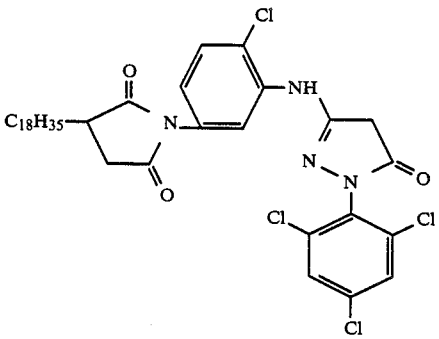

Cyan Coupler

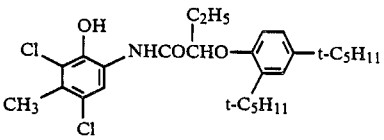

-continued

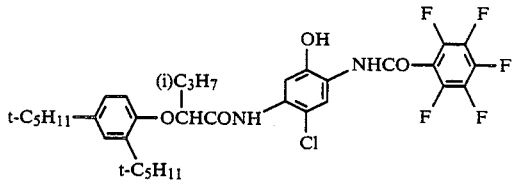

The multilayer color photographic paper obtained as above was processed in the same manner as the Example 3. The composition of each processing solution as used herein was as follows.

Color Developer

Triethanolamine: 8.0 g
Benzyl alcohol: See Table 3
N,N-diethylhydroxyamine: 4.2 g
Brightening Agent (4,4'-diaminostylbene-type): 3.0 g
Ethylenediaminetetraacetic Acid: 1.0 g
Potassium Carbonate: 30.0 g
Sodium Chloride: 1.4 g
4-Amino-3-methyl-N-ethyl-N-{β-(methanesulfonamido)ethyl}-p-phenylenediamine: Sulfate: 5.0 g
Potassium Bromide: See Table 3
Water to make: 1000 ml
pH: 10.05

Bleach-fixing Solution

EDTA/Fe(III)/$NH_4$.2$H_2O$: 60 g
EDTA.2Na.2$H_2O$: 4 g
Ammonium Thiosulfate (70 wt%): 120 ml
Sodium Sulfite: 16 g
Glacial Acetic Acid: 7 g
Water to make: 1000 ml
pH: 5.5

Rinsing Solution

EDTA.2Na.2$H_2O$: 0.4 g
Water to make: 1000 ml
pH: 7.0

Dmin and Dmax of the yellow density were measured, and the results obtained are set forth in the following Table 3.

TABLE 3

| Sample No. | KBr Concentration (mol/liter) | Benzyl Alcohol (ml/liter) | Note | Yellow Density Dmin | Yellow Density Dmax |
|---|---|---|---|---|---|
| 36 | $5 \times 10^{-3}$ | 15 | Comparison | 0.13 | 1.80 |
| 37 | " | 10 | " | 0.12 | 1.61 |
| 38 | " | 5 | " | 0.11 | 1.40 |
| 39 | " | 0 | " | 0.10 | 1.13 |
| 40 | $1 \times 10^{-3}$ | 15 | " | 0.18 | 2.02 |
| 41 | " | 10 | " | 0.16 | 2.02 |

TABLE 3-continued

| Sample No. | KBr Concentration (mol/liter) | Benzyl Alcohol (ml/liter) | Note | Yellow Density Dmin | Yellow Density Dmax |
|---|---|---|---|---|---|
| 42 | " | 5 | " | 0.14 | 2.01 |
| 43 | " | 0 | The invention | 0.10 | 2.00 |
| 44 | — | 15 | Comparison | 0.21 | 2.01 |
| 45 | — | 10 | " | 0.18 | 2.02 |
| 46 | — | 5 | " | 0.15 | 2.01 |
| 47 | — | 0 | The invention | 0.10 | 2.02 |
| | | 0 | | | |

Table 3 proves the following facts: If the KBr concentration exceeds the range of the present invention, the color forming property extremely deteriorates (Nos. 36 through 39), and if the color developer contains benzyl alcohol, the generation of the fog is noticeable even though the KBr concentration falls within the range of the present invention.

EXAMPLE 5

Silver halide emulsion (1) used in Example 5 was prepared as follows.

(Solution 1)

$H_2O$: 1000 ml
NaCl: 5.5 g
Gelatin: 32 g (Solution 2)

Sulfuric acaid (1N): 20 ml (Solution 3)

The following silver halide solvent (1 wt%): 3 ml

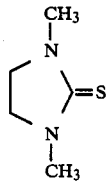

(Solution 4)

KBr: 0.18 g
NaCl: 8.51 g
$H_2O$ to make: 130 ml (Solution 5)

$AgNO_3$: 25 g
$NH_4NO_3$ (50 wt%): 0.5 ml
$H_2O$ to make: 130 ml (Solution 6)

KBr: 0.70 g
NaCl: 34.06 g
$K_2IrCl_6$ (0.001 wt%): 0.7 ml
$H_2O$ to make: 285 ml (Solution 7)

$AgNO_3$: 100 g
$NH_4NO_3$ (50 wt%): 1 ml
$H_2O$ to make: 285 ml (Solution 1) was heated at 75° C., and (Solution 2) and (Solution 3) were added thereto. Afterwards, (Solution 4) and (Solution 5) were added thereto at the same time in the course of 60 minutes. After 10 minutes, (Solution 6) and (Solution 7) were added at the same time in the course of 25 minutes. After 5 minutes from the last addition, the temperature was lowered and the resulting mixture was subjected to demineralization. Water and gelatin dispersion were added to the mixture, which was thereafter adjusted to have a pH of 6.2, to obtain a monodisperse cubic silver chlorobromide emulsion having an averag grain size of 1.02 μm, a variation coefficient (which is the value of the standard deviation as divided by the average grain size: s/d) of 0.08 and silver bromide content of 1 mol%. This emulsion was subjectd to gold-sensitization and sulfur-sensitization. The amount of the gold added was $1.0\times10^{-4}$ mol/mol (Ag), and the emulsion was subjected to the optimum chemical sensitization with sodium thiosulfate.

Next, silver halide emulsion (2) was prepared as follows.

(Solution 8)

$H_2O$: 1000 ml
NaCl: 5.5 g
Gelatin: 32 g (Solution 9)

Sulfuric acid (1N): 24 ml (Solution 10)

The same silver halide solvent (1 wt%) as the (Solution 2).: 3 ml (Solution 11)

KBr: 0.11 g
NaCl: 10.94 g
$H_2O$ to make: 220 ml (Solution 12)

$AgNO_3$: 32 g
$H_2O$ to make: 200 ml (Solution 13)

KBr: 0.45 g
NaCl: 43.83 g
$K_2IrCl_6$ (0.001 wt%): 4.5 ml
$H_2O$ to make: 600 ml (Solution 14)

$AgNO_3$: 128 g
$H_2O$ to make: 600 ml (Solution 8) was heated at 56° C., and (Solution 9) and (Solution 10) were added thereto. Afterwards, (Solution 11) and (Solution 12) were added thereto at the same time in the course of 10 minutes. 10 minutes after the addition, (Solution 13) and (Solution 14) were added at the same time in the course of 8 minutes. 5 minutes after the last addition, the temperature was lowered, and the resulting mixture was subjected to demineralization. Water and gelatin dispersion were added to the mixture, which was thereafter regulated to have pH 6.2, to obtain a monodispersed cubic silver chlorobromide emulsion having an average grain size of 0.45 m, a variation coefficient of 0.08 and silver bromide content of 0.5 mol%. To this emulsion was added $4.1\times10^{-4}$ mol/mol (Ag) of chloroauric acid for gold-sensitization thereof.

In the same manner, with the exception that the composition of (Solution 11) and (Solution 13) and the temperature were varied, another monodisperse cubic silver chlorobromide emulsion having an average grain size of 0.51 μm, a variation coefficient of 0.07 and silver bromide content of 1 mol% was obtained. This emulsion was subjected to gold-sensitization and sulfur-sensitization, to obtain silver halide emulsion (3). The amount of gold as added was $4.1\times10^{-4}$ mol/mol (Ag), and the optimum chemical sensitization was attained by the use of sodium thiosulfate.

A multi-layer color photographic paper was prepared by forming the layers having the compositions shown below on a paper support both surfaces of which were coated with polyethylene. The coating compositions for the layers were prepared as follows.

Coating Composition for First Layer

In a mixture of 27.2 ml of ethyl acetate and 7.9 ml of Solvent (c) were dissolved 19.1 g of Yellow Coupler (a) and 4.4 g of Color Image Stabilizer (b) and the solution thus obtained was dispersed by emulsification in 185 ml of an aqueous 10 wt% gelatin solution containing 8 ml of a 10 wt% sodium dodecylbenzenesulfonate solution. On the other hand, 90 g of a silver chlorobromide emulsion (containing 1.0 mol% silver bromide and 70 g/kg of silver) containing the blue-sensitive sensitizing dye shown below in an amount of $5.0\times10^{-4}$ mol per mol of silver chlorobromide was prepared. The emulsified dispersion prepared above was mixed with the aforesaid silver halide emulsion and the gelatin concentration was adjusted as shown below to provide the coating composition fo the first layer. Coating compositions for the second layer to the seventh layer were also prepared by the same manner as in the first layer. As a gelatin hardening agent for each layer, 2,4-dichloro-6-hydroxy-s-triazine sodium salt was used.

The compositions of the layers were as follows. In addition, the polyethylene-coated paper contained titanium dioxide as a white pigment and ultramarine as a bluish dye.

First Layer: Blue-Sensitive Emulsion Layer

Mixed silver chlorobromide emulsion (silver bromide: 1.0 mol%) (above described emulsion (1)): 0.30 g/m² as Ag (silver content)
Gelatin: 1.86 g/m²
Yellow Coupler (a): 0.82 g/m²
Color Image Stabilizer (b): 0.19 g/m²
Solvent (c): 0.34 ml/m²

Second Layer: Color Mixing Preventing Layer

Gelatin: 0.99 g/m²
Color Mixing Preventing Agent (d): 0.08 g/m²

Third Layer: Green-Sensitive Emulsion Layer

Mixed silver chlorobromide emulsion (silver bromide: 0.5 mol%) (above described emulsion (2)): 0.16 g/m² as Ag
Gelatin: 1.80 g/m²
Magenta coupler (m): 0.34 g/m²
Color Image Stabilizer (f): 0.20 g/m²
Solvent (g): 0.68 ml/m²

Fourth Layer: Ultraviolet Absorbing Layer

Gelatin: 1.60 g/m²
Ultraviolet Absorbent (h): 0.62 g/m²
Color Mixing Preventing Agent (i): 0.05 g/m²
Solvent (j): 0.26 ml/m²

Fifth Layer: Red-Sensitive Emulsion Layer

Mixed silver chlorobromide emulsion (silver bromide: 1.0 mol%) (above described emulsion (3)): 0.26 g/m² as Ag
Gelatin: 0.98 g/m²
Cyan Coupler (k): 0.38 g/m²
Color Image Stabilizer (l): 0.17 g/m²
Solvent (e): 0.23 ml/m²

Sixth Layer: Ultraviolet Absorbing Layer

Gelatin: 0.54 g/m²
Ultraviolet Absorbent (h): 0.21 g/m²
Solvent (j): 0.09 ml/m²

Seventh Layer: Protective Layer

Gelatin: 1.33 g/m²
Acryl-modified copolymer of polyvinyl alcohol (modification degree of 17%): 0.17 g/m²

As the spectral sensitizer in each emulsion, the following substance were used:

Blue-Sensitive Emulsion Layer

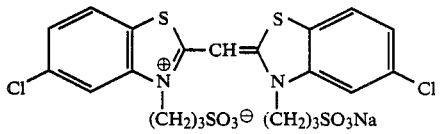

(Amount added: $5.0\times10^{-4}$ mol per mol of silver halide)

Green-Sensitive Emulsion Layer

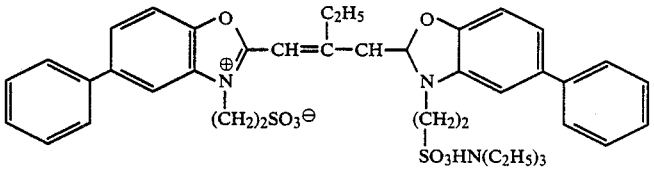

(Amount added: $4.0\times10^{-4}$ mol per mol of silver halide)

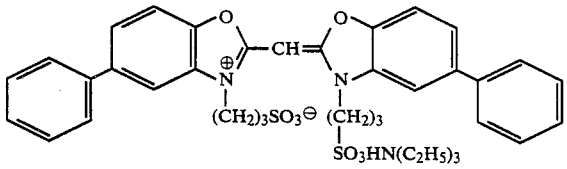

(Amount added: $7.0\times10^{-5}$ mol per mol of silver halide)

Red-sensitive Emulsion Layer

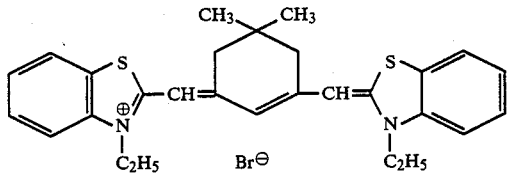

(Amount added: $0.9\times10^{-4}$ mol per mol of silver halide)

As the anti-irradiation dye in each emulsion layer, the follwing dyes were used.

Green-sensitive Emulsion Layer

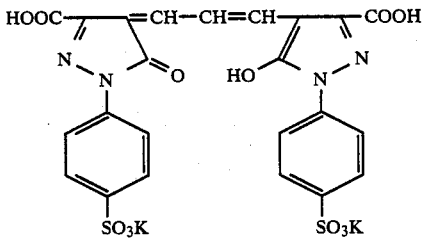

Red-sensitive Emulsion Layer

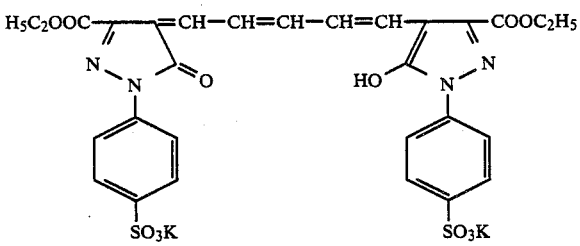

The other compounds, including couplers, used in Example 5 have the following structural formulae.

(a) Yellow coupler:

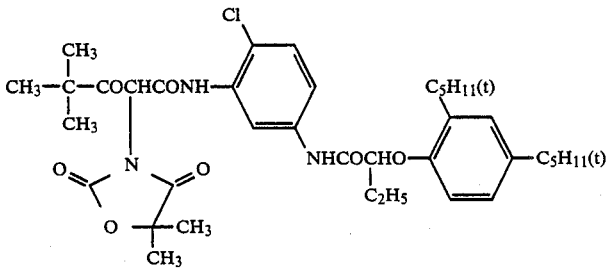

(b) Color Image Stabilizer

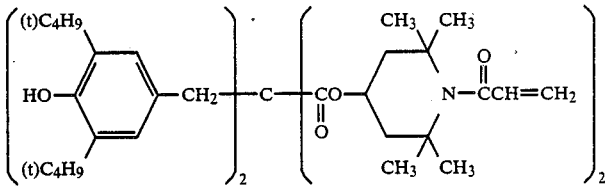

(c) Solvent

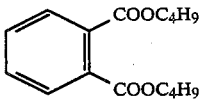

(d) Color Mixing Preventing Agent

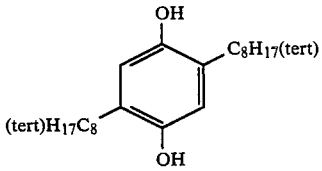

(e) Solvent

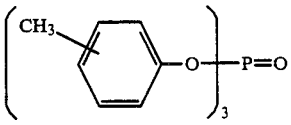

(f) Color Image Stabilizer

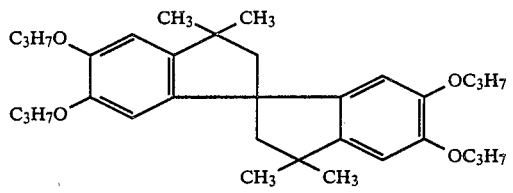

(g) Solvent

Mixture (2/1, by weight ratio) of the following compounds.

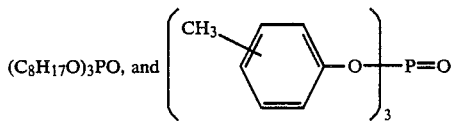

(h) Ultraviolet Absorbent

Mixture (1/5/3, by molar ratio) of the following compounds.

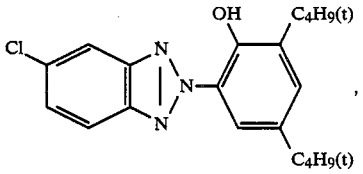

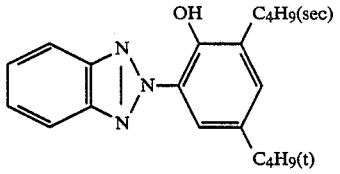

and

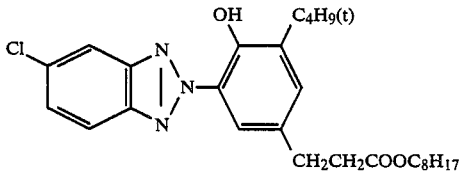

(i) Color Mixing Preventing Agent

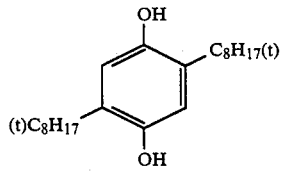

(j) Solvent $(iso\ C_9H_{19}O)_3P{=}O$ (k) Cyan Coupler

Mixture (1/1, by molar ratio) of the following compounds.

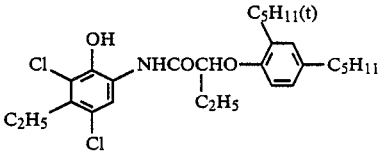

and

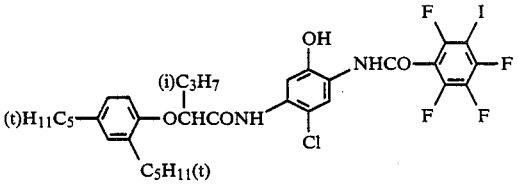

(l) Color Image Stabilizer

Mixture (1/3/3, by molar ratio) of the following compounds.

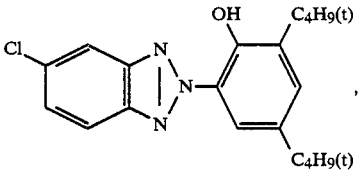

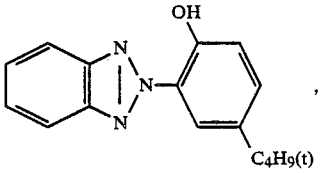

and

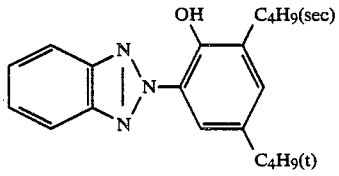

(m) Magenta Coupler

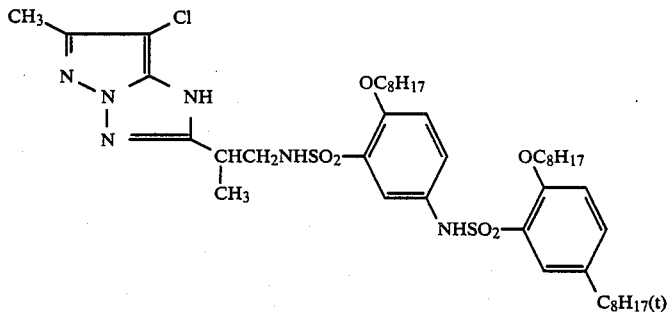

The color photographic paper obtained as above was processed in the same manner as in Example 4, by the same processing steps and with the same processing solutions, with the exception that the color development time was varied as shown in the following Table 4.

Dmin and Dmax of the formed magenta dye were measured, and the results obtained are set forth in the Table 4.

TABLE 4

| Sample No. | KBr Concentration (mol/liter) | Benzyl Alcohol Concentration (ml/liter) | Note | Magenta Density 45 sec Dmin | 45 sec Dmax | 2 min 30 sec Dmin | 2 min 30 sec Dmax |
|---|---|---|---|---|---|---|---|
| 48 | $5 \times 10^{-3}$ | 15 | Comparison | 0.13 | 1.78 | 0.17 | 1.93 |
| 49 | " | 7 | " | 0.12 | 1.60 | 0.14 | 1.80 |
| 50 | " | 0 | " | 0.12 | 1.45 | 0.12 | 1.74 |
| 51 | $1 \times 10^{-3}$ | 15 | " | 0.21 | 2.21 | 0.26 | 2.21 |
| 52 | " | 10 | " | 0.18 | 2.21 | 0.21 | 2.20 |
| 53 | " | 5 | " | 0.15 | 2.20 | 0.18 | 2.21 |
| 54 | " | 0 | The invention | 0.12 | 2.20 | 0.15 | 2.20 |
| 55 | " | 15 | Comparison | 0.24 | 2.20 | 0.30 | 2.21 |
| 56 | " | 10 | " | 0.20 | 2.21 | 0.25 | 2.21 |
| 57 | " | 5 | " | 0.16 | 2.21 | 0.20 | 2.20 |
| 58 | " | 0 | The invention | 0.12 | 2.21 | 0.15 | 2.20 |

The Table 4 proves the following facts: If the KBr concentration exceeds the range of the present invention, the color forming property is poor (Nos. 48, 49, and 50). The incorporation of benzyl alcohol in the color developer results in the noticeable generation of the fog even though the KBr concentration falls within the range of the present invention (Nos. 51, 52, 53, 55, 56, and 57). Longer development times of over 2 minutes are unfavorable, as causing the relatively noticeable generation of fog.

The effect of the present invention is summarized as follows: In the practice of the present invention, the incorporation of benzyl alcohol in the color developer can substantially be evaded, whereby the environmental pollution load can noticeably be reduced and the load in the preparation of the photographic processing solutions can further be reduced. In addition, the conversion of the cyan dye into the eluco form can be inhibited, whereby the decrement of the color density of the formed color image can be eliminated. Moreover, a large amount of color prints can rapidly be processed, and thus, the mass-productivity of color prints can remarkably be improved. In accordance with the present invention, the color photographic materials can be processed with color developer which does not substantially contain benzyl alcohol in a short period of time to obtain good color images, and the decrement of the colored density is less and the generation of the fog is less in the thus formed color images.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material, wherein a silver halide color photographic material having at least one silver halide emulsion layer on a reflective support is, after having been imagewise exposed, subjectd to color development with a color developer which contains benzyl alcohol in an amount of 0.5 ml/liter or less and which contains bromide ion in an amount of $2 \times 10^{-3}$ mol/liter or less, for a period of time of 2 minutes or less, said silver halide being a silver chlorobromide which does contains 1 mol% or less silver iodide and which contains silver chloride in an amount of more than 50 mol%.

2. A method for processing a silver halide color photographic material as in claim 1, wherein said silver chlorobromide contains silver chloride in an amount of 60 mol% or more.

3. A method for processing a silver halide color photographic material as in claim 2, wherein said silver chlorobromide contains silver chloride in an amount of 90 mol% or more.

4. A method for processing a silver halide color photographic material as in claim 1, wherein said silver halide color photographic material contains a magenta coupler of formula (I)

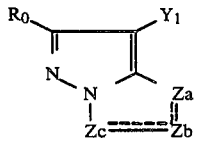

(I)

in which $R_0$ represents a hydrogen atom or a substituent; $Y_1$ represents a group capable of being released by the coupling reaction with the oxidation product form of an aromatic primary amine developing agent; Za, Zb, and Zc each represents a substituted or unsubstituted methine group, =N—, or —NH—; and at least one of said Za—Zb bond and said Zb—Zc bond is a double bond and the other is a single bond.

5. A method for processing a silver halide color photographic material as in claim 4, wherein said magenta coupler is selected from 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles which are represented by formulae (II), (III), (IV), (V), (VI), and (VII), respectively

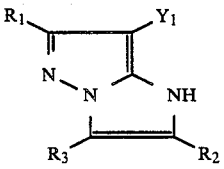

(II)

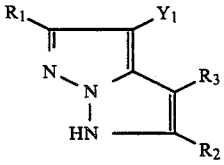

(III)

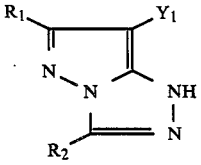

(IV)

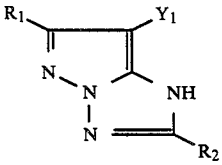

(V)

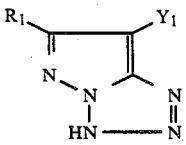

(VI)

-continued

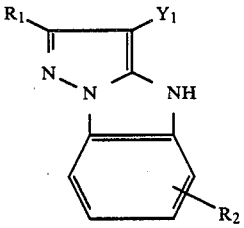

(VII)

wherein $R_1$, $R_2$, and $R_3$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycabonyl group; $Y_1$ represents a hydrogen atom, a halogen atom, a carboxyl group, or a coupling releasable group capable of being released upon coupling by being bonded with the carbon atom at the coupling position of the coupler through an oxygen atom, a nitrogen atom or a sulfur atom; or $R_1$, $R_2$, $R_3$, or $Y_1$ is a divalent group forming a bis-structural compound; when a moiety represented by one of formulae (II) through (VII) exists in a vinyl-structural monomer, $R_1$, $R_2$, or $R_3$ may be a simple bond or a connecting group and the moiety shown by formulae (II) through (VII) is bonded to the vinyl group through said bond or connecting group.

6. A method for processing a silver halide color photographic material as in claim 5, wherein said magenta coupler is represented by formula (V).

7. A method for processing a silver halide color photographic material as in claim 2, wherein said silver halide color photographic material contains a magenta coupler represented by formula (IV) or (V) wherein at least one of $R_1$ and $R_2$ is a branched substituted or unsubstituted alkyl group that is an alkyl group or a substituted alkyl group which is connected to a pyrazoloazole skeleton through a secondary or tertiary carbon atom.

8. A method for processing a silver halide color photographic material as in claim 7, wherein the secondary or tertiary carbon atom has at least two group selected from an alkyl group or a substituted alkyl group.

9. A method for processing a silver halide color photographic material as in claim 8, wherein the secondary or tertiary carbon atom has at least one of a sulfonamido alkyl group, a sulfonamidoaryl alkyl group, or a sulfonylalkyl group.

10. A method for processing a silver halide color photographic material as in claim 2, wherein said silver halide color photographic material contains a magenta couplers represented by formula (VIII) or (IX):

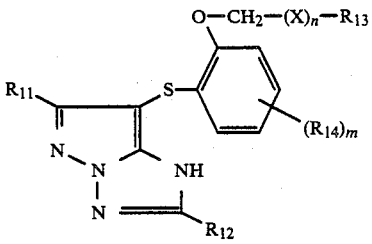

(VIII)

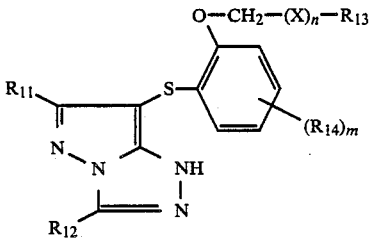

(IX)

wherein $R_{11}$ and $R_{12}$ each represents a substituent as defined by $R_1$ and $R_2$, at least one of said $R_{11}$ and $R_{12}$ representing a group bonding to the pyrazoloazole nucleus by a nitrogen atom, oxygen atom, or sulfur atom thereof as exemplified before; X represents —$CH_2$—O—, —$CH_2O$—$CH_2CH_2O$—, —$CH_2SO_2$—, —$CH_2CH_2CH_2SO_2NH$—, —$CH_2CH_2CH_2SO_2NHCH_2CH_2O$—, —$CH_2CH_2CONH$—, —$CH_2$—COO—, —$CH_2CONH$—, —$CH_2CH_2CONH$—, —$CH_2CH_2SO_2$—, —$CH_2CH_2SO_2NH$—, —$CH_2CH_2NHSO_2$—, —$CH_2NHSO_2$—, —$CH_2NHCO$—,

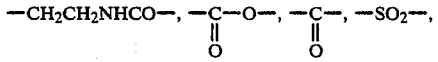

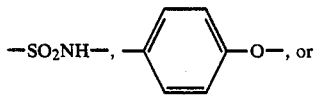

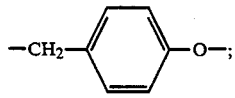

$R_{13}$ represents an alkyl group or an aryl group; $R_{14}$ represents a halogen atom, an alkoxy group, an alkyl group, an aryl group, a hydroxyl group, an amino group, an N-alkylamino group, an N,N-dialkylamino group, an N-anilino group, an acylamino group, a ureido group, an alkoxycarbonylamino group, an imido group, a sulfonamido group, a sulfamoylamino group, an alkoxycarbonyl group, a carbamoyl group, an acyl group, a cyano group, or an alkylthio group; n represents 0 or 1; m represents 0 or an integer of 1 to 4; and when m is 2 or more, said $R_{14}$ groups may be the same or different.

11. A method for processing a silver halide color photographic material as in claim 10, wherein the magenta coupler is represented by formula (VIII) wherein $R_{11}$ is an alkoxy group, a ureido group, or an aryloxy group, and $R_{12}$ is an alkyl group.

12. A method for processing a silver halide color photographic material as in claim 10, wherein the magenta coupler is represented by formula (IX) wherein $R_{11}$ is an alkyl group or an alkoxy group, and $R_{12}$ is an alkylthio group.

13. A method for processing a silver halide color photographic material as in claim 1, wherein said color developer does not contain benzyl alcohol at all.

14. A method for processing a silver halide color photographic material as in claim 1, wherein said color developer contains an aromatic primary amine color developing agent.

15. A method for processing a silver halide color photographic material as in claim 1, wherein said aromatic primary amine color developing agent is N-ethyl-N-(β-methanesulfonamidoethyl)-3-methyl-4-aminoaniline or N-ethyl-N-(β-hydroxyethyl)-3-methyl-4-aminoaniline.

16. A method for processing a silver halide color photographic material as in claim 1, wherein the color developer contains hydroxylamines.

17. A method for processing a silver halide color photographic material as in claim 16, wherein the hydroxyl amines are those having an alkyl group bonded to a nitrogen atom thereof.

18. A method for processing a silver halide color photographic material as in claim 1, wherein the color developer contains at least one of aromatic polyhydroxyl compounds and alkanolamines.

19. A method for processing a silver halide color photographic material as in claim 1, wherein the color developer contains 4,4'-diamino-2,2'-disulfostylbene type compounds.

20. A method for processing a silver halide color photographic material as in claim 1, wherein the color development is carried out for a period of time of from 30 seconds to 1 minute.

21. A method for processing a silver halide color photographic material as in claim 1, wherein the color developer contains a bromide ion in an amount of $3\times10^{-3}$ mol/liter or less.

22. A method for processing a silver halide color photographic material as in claim 1, wherein the color developer contains an inorganic or organic antifoggant.

23. A method for processing a silver halide color photographic material as in claim 1, wherein the organic antifoggant is selected from antifoggants (1), (3), (10), (13), (22), (146), (147) and (148):

(1)

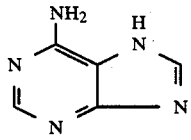

(3)

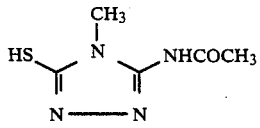

(10)

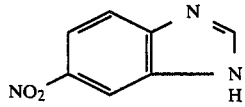

(13)

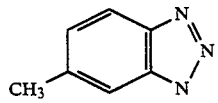

-continued
(22)
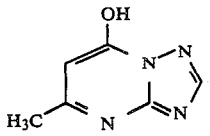
(146)
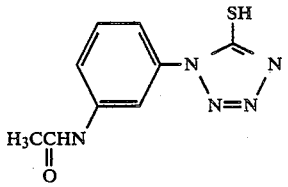
-continued
(147)
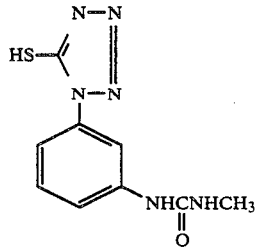
(148)
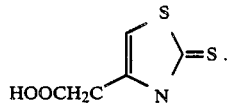
* * * * *